US008395645B2

(12) United States Patent
Origuchi et al.

(10) Patent No.: US 8,395,645 B2
(45) Date of Patent: Mar. 12, 2013

(54) PLASMA DISPLAY DEVICE AND DRIVE METHOD OF PLASMA DISPLAY PANEL

(75) Inventors: Takahiko Origuchi, Osaka (JP); Hidehiko Shoji, Osaka (JP); Kazuhiro Yamada, Osaka (JP)

(73) Assignee: Panasonic Corporation, Osaka (JP)

( * ) Notice: Subject to any disclaimer, the term of this patent is extended or adjusted under 35 U.S.C. 154(b) by 375 days.

(21) Appl. No.: 12/863,668

(22) PCT Filed: May 13, 2009

(86) PCT No.: PCT/JP2009/002071

§ 371 (c)(1), (2), (4) Date: Jul. 20, 2010

(87) PCT Pub. No.: WO2009/139151

PCT Pub. Date: Nov. 19, 2009

(65) Prior Publication Data

US 2011/0050752 A1 Mar. 3, 2011

(30) Foreign Application Priority Data

May 14, 2008 (JP) ..... 2008-126757

(51) Int. Cl.
*G09G 5/10* (2006.01)
*G09G 3/10* (2006.01)
*G09G 3/28* (2006.01)

(52) U.S. Cl. ..... 345/691; 345/37; 345/41; 345/60; 345/62

(58) Field of Classification Search ..... 345/37, 345/41, 60–72, 691
See application file for complete search history.

(56) References Cited

U.S. PATENT DOCUMENTS

| | | | | |
|---|---|---|---|---|
| 6,614,413 | B2 | 9/2003 | Tokunaga et al. | |
| 6,956,592 | B2 * | 10/2005 | Yamada et al. | 345/691 |
| 7,750,871 | B2 | 7/2010 | Shoji et al. | |
| 2002/0054000 | A1 | 5/2002 | Tokunaga et al. | |
| 2004/0070590 | A1 * | 4/2004 | Lee et al. | 345/690 |

(Continued)

FOREIGN PATENT DOCUMENTS

| | | | |
|---|---|---|---|
| CN | 1234577 | A | 11/1999 |
| CN | 1555547 | A | 12/2004 |

(Continued)

OTHER PUBLICATIONS

Chinese Office Action for 2009-80112294.4 dated Sep. 12, 2012.

*Primary Examiner* — Alexander S Beck
*Assistant Examiner* — Nguyen H Truong
(74) *Attorney, Agent, or Firm* — RatnerPrestia

(57) ABSTRACT

Crosstalk between adjacent discharge cells is reduced for a stable sustain discharge. A plasma display panel has scan electrodes and sustain electrodes arranged so that the positions of the corresponding scan electrode and sustain electrode are alternately interchanged in each display electrode pair, and image signal processing circuit converts an image signal into image data indicating light emission and no light emission in each discharge cell in each subfield. The image signal processing circuit generates the image data so that a combination of image data is avoided. One of two adjacent discharge cells having side-by-side scan electrodes is lit and the other of the discharge cells is unlit in one subfield of a plurality of subfields forming one field, and the one of the discharge cells is unlit and the other of the discharge cells is lit in a subfield after the one subfield in the same field.

18 Claims, 28 Drawing Sheets

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 1 | 1 | 1 | 0 | 1 | 1 |
| Discharge cell B | 1 | 1 | 1 | 1 | 0 | 1 | 1 | 0 |

⇩ ⇩

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 1 | 1 | 1 | 0 | 1 | 1 |
| Discharge cell B | 1 | 1 | 1 | 1 | 1 | 0 | 1 | 0 |

1 : Light emission
0 : No light emission

U.S. PATENT DOCUMENTS

| | | | | |
|---|---|---|---|---|
| 2004/0239589 | A1 | 12/2004 | Nishimura et al. | |
| 2006/0007060 | A1* | 1/2006 | Hsu et al. | 345/60 |
| 2006/0132049 | A1* | 6/2006 | Ikura et al. | 315/169.1 |
| 2007/0229399 | A1* | 10/2007 | Yamamoto et al. | 345/60 |
| 2007/0262923 | A1* | 11/2007 | Kobayashi et al. | 345/60 |
| 2008/0309591 | A1 | 12/2008 | Shoji et al. | |

FOREIGN PATENT DOCUMENTS

| | | | |
|---|---|---|---|
| CN | 1924978 | A | 3/2007 |
| CN | 101019163 | A | 8/2007 |
| JP | 08-212933 | A | 8/1996 |
| JP | 08212933 | A | 8/1996 |
| JP | 2000-227778 | A | 8/2000 |
| JP | 2000227778 | A | 8/2000 |
| JP | 2006-018298 | A | 1/2006 |
| JP | 2007-304267 | A | 11/2007 |
| KR | 2006-024868 | A | 3/2006 |
| WO | WO 03/010744 | A1 | 2/2003 |

* cited by examiner

FIG. 6A

| Subfield | 1 | 2 | 3 | 4 | 5 | 6 | 7 | 8 |
|---|---|---|---|---|---|---|---|---|
| Luminance weight | 1 | 2 | 4 | 8 | 16 | 30 | 57 | 108 |
| Gradation value 0 | 0 | 0 | 0 | 0 | 0 | 0 | 0 | 0 |
| 1 | 1 | 0 | 0 | 0 | 0 | 0 | 0 | 0 |
| 2 | 0 | 1 | 0 | 0 | 0 | 0 | 0 | 0 |
| 3 | 1 | 1 | 0 | 0 | 0 | 0 | 0 | 0 |
| 4 | 0 | 0 | 1 | 0 | 0 | 0 | 0 | 0 |
| 5 | 1 | 0 | 1 | 0 | 0 | 0 | 0 | 0 |
| 6 | 0 | 1 | 1 | 0 | 0 | 0 | 0 | 0 |
| 7 | 1 | 1 | 1 | 0 | 0 | 0 | 0 | 0 |
| 8 | 0 | 0 | 0 | 1 | 0 | 0 | 0 | 0 |
| 9 | 1 | 0 | 0 | 1 | 0 | 0 | 0 | 0 |
| 10 | 0 | 1 | 0 | 1 | 0 | 0 | 0 | 0 |
| 11 | 1 | 1 | 0 | 1 | 0 | 0 | 0 | 0 |
| 12 | 0 | 0 | 1 | 1 | 0 | 0 | 0 | 0 |
| 13 | 1 | 0 | 1 | 1 | 0 | 0 | 0 | 0 |
| 14 | 0 | 1 | 1 | 1 | 0 | 0 | 0 | 0 |
| 15 | 1 | 1 | 1 | 1 | 0 | 0 | 0 | 0 |
| 16 | 0 | 0 | 0 | 0 | 1 | 0 | 0 | 0 |
| 17 | 1 | 0 | 0 | 0 | 1 | 0 | 0 | 0 |
| 18 | 0 | 1 | 0 | 0 | 1 | 0 | 0 | 0 |
| 19 | 1 | 1 | 0 | 0 | 1 | 0 | 0 | 0 |
| 20 | 0 | 0 | 1 | 0 | 1 | 0 | 0 | 0 |
| 21 | 1 | 0 | 1 | 0 | 1 | 0 | 0 | 0 |
| 22 | 0 | 1 | 1 | 0 | 1 | 0 | 0 | 0 |
| 23 | 1 | 1 | 1 | 0 | 1 | 0 | 0 | 0 |
| 25 | 1 | 0 | 0 | 1 | 1 | 0 | 0 | 0 |
| 27 | 1 | 1 | 0 | 1 | 1 | 0 | 0 | 0 |
| 29 | 1 | 0 | 1 | 1 | 1 | 0 | 0 | 0 |
| 31 | 1 | 1 | 1 | 1 | 1 | 0 | 0 | 0 |
| 33 | 1 | 1 | 0 | 0 | 0 | 1 | 0 | 0 |
| 35 | 1 | 0 | 1 | 0 | 0 | 1 | 0 | 0 |
| 37 | 1 | 1 | 1 | 0 | 0 | 1 | 0 | 0 |

1 : Light emission
0 : No light emission

FIG. 6B

| Subfield | 1 | 2 | 3 | 4 | 5 | 6 | 7 | 8 |
|---|---|---|---|---|---|---|---|---|
| Luminance weight | 1 | 2 | 4 | 8 | 16 | 30 | 57 | 108 |
| Gradation value 39 | 1 | 0 | 0 | 1 | 0 | 1 | 0 | 0 |
| 41 | 1 | 1 | 0 | 1 | 0 | 1 | 0 | 0 |
| 45 | 1 | 1 | 1 | 1 | 0 | 1 | 0 | 0 |
| 49 | 1 | 1 | 0 | 0 | 1 | 1 | 0 | 0 |
| 53 | 1 | 1 | 1 | 0 | 1 | 1 | 0 | 0 |
| 57 | 1 | 1 | 0 | 1 | 1 | 1 | 0 | 0 |
| 61 | 1 | 1 | 1 | 1 | 1 | 1 | 0 | 0 |
| 64 | 1 | 1 | 1 | 0 | 0 | 0 | 1 | 0 |
| 68 | 1 | 1 | 0 | 1 | 0 | 0 | 1 | 0 |
| 72 | 1 | 1 | 1 | 1 | 0 | 0 | 1 | 0 |
| 80 | 1 | 1 | 1 | 0 | 1 | 0 | 1 | 0 |
| 88 | 1 | 1 | 1 | 1 | 1 | 0 | 1 | 0 |
| 94 | 1 | 1 | 1 | 0 | 0 | 1 | 1 | 0 |
| 102 | 1 | 1 | 1 | 1 | 0 | 1 | 1 | 0 |
| 110 | 1 | 1 | 1 | 0 | 1 | 1 | 1 | 0 |
| 118 | 1 | 1 | 1 | 1 | 1 | 1 | 1 | 0 |
| 123 | 1 | 1 | 1 | 1 | 0 | 0 | 0 | 1 |
| 139 | 1 | 1 | 1 | 1 | 1 | 0 | 0 | 1 |
| 153 | 1 | 1 | 1 | 1 | 0 | 1 | 0 | 1 |
| 169 | 1 | 1 | 1 | 1 | 1 | 1 | 0 | 1 |
| 196 | 1 | 1 | 1 | 1 | 1 | 0 | 1 | 1 |
| 226 | 1 | 1 | 1 | 1 | 1 | 1 | 1 | 1 |

1 : Light emission
0 : No light emission

FIG. 8A

| | First SF | Second SF | Third SF | Fourth SF | Fifth SF | Sixth SF | Seventh SF | Eighth SF | Gradation value |
|---|---|---|---|---|---|---|---|---|---|
| Discharge cell A | 1 | 1 | 1 | 1 | 1 | 0 | 1 | 1 | 196 |
| Discharge cell B | 1 | 1 | 1 | 1 | 0 | 1 | 1 | 0 | 102 |

1 : Light emission
0 : No light emission

FIG. 8B

| | First SF | Second SF | Third SF | Fourth SF | Fifth SF | Sixth SF | Seventh SF | Eighth SF | Gradation value |
|---|---|---|---|---|---|---|---|---|---|
| Discharge cell A | 1 | 1 | 0 | 1 | 1 | 0 | 0 | 0 | 27 |
| Discharge cell B | 1 | 1 | 1 | 1 | 0 | 1 | 1 | 0 | 102 |

1 : Light emission
0 : No light emission

FIG. 8C

| | First SF | Second SF | Third SF | Fourth SF | Fifth SF | Sixth SF | Seventh SF | Eighth SF | Gradation value |
|---|---|---|---|---|---|---|---|---|---|
| Discharge cell A | 1 | 1 | 0 | 1 | 1 | 1 | 0 | 0 | 57 |
| Discharge cell B | 1 | 1 | 1 | 1 | 1 | 0 | 1 | 1 | 196 |

1 : Light emission
0 : No light emission

FIG. 9A

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 1 | 1 | 1 | 0 | 1 | 1 |
| Discharge cell B | 1 | 1 | 1 | 1 | 0 | 1 | 1 | 0 |

⇩ ⇩

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 1 | 1 | 1 | 0 | 1 | 1 |
| Discharge cell B | 1 | 1 | 1 | 1 | 1 | 0 | 1 | 0 |

1 : Light emission
0 : No light emission

FIG. 9B

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 0 | 1 | 1 | 1 | 0 | 0 |
| Discharge cell B | 1 | 1 | 1 | 1 | 0 | 0 | 0 | 0 |

⇩ ⇩

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 0 | 1 | 1 | 1 | 0 | 0 |
| Discharge cell B | 1 | 1 | 0 | 1 | 1 | 0 | 0 | 0 |

1 : Light emission
0 : No light emission

FIG. 10

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 0 | 0 | 1 | 1 | 0 | 0 |
| Discharge cell B | 1 | 1 | 1 | 1 | 0 | 0 | 0 | 0 |

⇩ ⇩

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 0 | 0 | 1 | 1 | 1 | 0 |
| Discharge cell B | 1 | 1 | 0 | 1 | 1 | 0 | 0 | 0 |

⇩ ⇩

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 0 | 0 | 1 | 1 | 1 | 0 |
| Discharge cell B | 1 | 1 | 0 | 0 | 1 | 1 | 0 | 0 |

1 : Light emission
0 : No light emission

FIG. 11A

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 1 | 1 | 1 | 0 | 1 | 1 |
| Discharge cell B | 1 | 1 | 1 | 1 | 0 | 1 | 1 | 0 |

⇩ ⇩ ⇩

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 1 | 1 | 1 | 0 | 1 | 1 |
| Discharge cell B | 1 | 1 | 1 | 1 | 1 | 0 | 1 | 1 |

1 : Light emission
0 : No light emission

FIG. 11B

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 0 | 1 | 1 | 0 | 0 | 0 |
| Discharge cell B | 1 | 1 | 1 | 1 | 0 | 1 | 1 | 0 |

⇩ ⇩ ⇩ ⇩

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 0 | 1 | 1 | 0 | 0 | 0 |
| Discharge cell B | 1 | 1 | 0 | 1 | 1 | 0 | 0 | 0 |

1 : Light emission
0 : No light emission

FIG. 12A

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 0 | 1 | 1 | 1 | 0 | 0 |
| Discharge cell B | 1 | 1 | 1 | 1 | 0 | 1 | 0 | 0 |

⇩

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 0 | 1 | 1 | 1 | 0 | 0 |
| Discharge cell B | 1 | 1 | 0 | 1 | 0 | 1 | 0 | 0 |

1 : Light emission
0 : No light emission

FIG. 12B

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 1 | 1 | 1 | 0 | 1 | 1 |
| Discharge cell B | 1 | 1 | 1 | 1 | 0 | 1 | 1 | 0 |

⇩

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 1 | 1 | 1 | 0 | 1 | 1 |
| Discharge cell B | 1 | 1 | 1 | 1 | 0 | 0 | 1 | 0 |

1 : Light emission
0 : No light emission

FIG. 14

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 0 | 1 | 1 | 1 | 0 | 0 |
| Discharge cell B | 1 | 1 | 1 | 1 | 0 | 1 | 0 | 0 |

⇩ ⇩

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 0 | 1 | 1 | 1 | 0 | 0 |
| Discharge cell B | 1 | 1 | 0 | 1 | 1 | 1 | 0 | 0 |

⇩ ⇩ ⇩

| | First SF | Second SF | Third SF | Fourth SF | Fifth SF | Sixth SF | Seventh SF | Eighth SF |
|---|---|---|---|---|---|---|---|---|
| Discharge cell A | 1 | 1 | 0 | 1 | 1 | 1 | 0 | 0 |
| Discharge cell B | 0 | 0 | 0 | 0 | 1 | 1 | 0 | 0 |

1 : Light emission
0 : No light emission

FIG. 16

| Subfield | First SF | Second SF | Third SF | Fourth SF | Fifth SF | Sixth SF | Seventh SF | Eighth SF |
|---|---|---|---|---|---|---|---|---|
| Luminance weight | 1 | 2 | 4 | 8 | 16 | 30 | 57 | 108 |
| Gradation value 0 | 0 | 0 | 0 | 0 | 0 | 0 | 0 | 0 |
| 1 | 1 | 0 | 0 | 0 | 0 | 0 | 0 | 0 |
| 3 | 1 | 1 | 0 | 0 | 0 | 0 | 0 | 0 |
| 7 | 1 | 1 | 1 | 0 | 0 | 0 | 0 | 0 |
| 15 | 1 | 1 | 1 | 1 | 0 | 0 | 0 | 0 |
| 31 | 1 | 1 | 1 | 1 | 1 | 0 | 0 | 0 |
| 61 | 1 | 1 | 1 | 1 | 1 | 1 | 0 | 0 |
| 118 | 1 | 1 | 1 | 1 | 1 | 1 | 1 | 0 |
| 226 | 1 | 1 | 1 | 1 | 1 | 1 | 1 | 1 |

1 : Light emission
0 : No light emission

FIG. 23C

| | First SF | Second SF | Third SF | Fourth SF | Fifth SF | Sixth SF | Seventh SF | Eighth SF | Gradation value |
|---|---|---|---|---|---|---|---|---|---|
| Discharge cell A | 1 | 1 | 1 | 1 | 0 | 1 | 0 | 0 | 45 |
| Discharge cell B | 1 | 1 | 0 | 0 | 1 | 1 | 0 | 0 | 49 |

PLASMA DISPLAY DEVICE AND DRIVE METHOD OF PLASMA DISPLAY PANEL

This application is a U.S. National Phase Application of PCT International Application PCT/JP2009/002071.

TECHNICAL FIELD

The present invention relates to a plasma display device for use in a wall-mounted television or a large monitor, and to a driving method for a plasma display panel.

BACKGROUND ART

A typical alternating-current surface-discharge panel used as a plasma display panel (hereinafter simply referred to as "panel") has a large number of discharge cells that are formed between a front plate and a rear plate facing each other. The front plate has the following elements:

- a plurality of display electrode pairs, each formed of a scan electrode and a sustain electrode, disposed on a front glass substrate parallel to each other; and
- a dielectric layer and a protective layer formed to cover the display electrode pairs.

The rear plate has the following elements:

- a plurality of parallel data electrodes formed on a rear glass substrate;
- a dielectric layer formed over the data electrodes to cover the data electrodes;
- a plurality of barrier ribs formed on the dielectric layer parallel to the data electrodes; and
- phosphor layers formed on the surface of the dielectric layer and on the side faces of the barrier ribs.

The front plate faces the rear plate so that the display electrode pairs three-dimensionally intersect with the data electrodes, and these plates are sealed together. A discharge gas containing xenon in a partial pressure ratio of 5%, for example, is charged into the sealed inside discharge space. Discharge cells are formed in portions where the display electrode pairs face the data electrodes. In a panel having such a structure, a gas discharge generates ultraviolet light in each discharge cell. This ultraviolet light excites red (R), green (G), and blue (G) phosphors so that the phosphors emit the corresponding colors for color display.

A subfield method is typically used as a method for driving the panel (see Patent Literature 1, for example). In the subfield method, one field is divided into a plurality of subfields, and light emission or no light emission of each discharge cell in each subfield provides gradation display. Each subfield has an initializing period, an address period, and a sustain period.

In the initializing period, an initializing waveform is applied to each scan electrode, and an initializing discharge is generated in each discharge cell. This initializing discharge forms wall charge necessary for the subsequent address operation in each discharge cell.

In the address period, a scan pulse is applied sequentially to the scan electrodes (hereinafter this operation also being referred to as "scanning"). Address pulses corresponding to the signals of an image to be displayed are applied to the data electrodes (hereinafter, these operations being also generically referred to as "addressing"). Thereby, an address discharge is selectively caused between the scan electrodes and the data electrodes, to selectively form wall charge.

In the subsequent sustain period, sustain pulses corresponding in number to a luminance to be displayed are applied alternately to display electrode pairs, each formed of a scan electrode and a sustain electrode. Thereby, a sustain discharge is selectively caused in the discharge cells where the address discharge has formed wall charge, and causes the discharge cells to emit light. In this manner, an image is displayed.

The plurality of scan electrodes are driven by a scan electrode driving circuit, the plurality of sustain electrodes are driven by a sustain electrode driving circuit, and the plurality of data electrodes are driven by a data electrode driving circuit.

Further, a plasma display device where the scan electrode and sustain electrode forming a display electrode pair are interchanged alternately in each electrode pair is proposed (see Patent Literature 2, for example).

Recently, the inter-electrode capacitance in a panel has been increased as increases in the screen size and definition of the panel are promoted. The increase in the inter-electrode capacitance increases reactive power, which makes no contribution to light emission and is ineffectively consumed when the panel is driven. Thus the increase in the inter-electrode capacitance is one of the causes for increasing power consumption. In the panel having the electrode structure disclosed in Patent Literature 2, the voltage in adjacent discharge cells can be changed in phase with each other, and thus the reactive power can be reduced.

However, it is found that a phenomenon of electric charge transfer from one to the other of adjacent discharge cells that have scan electrodes disposed side by side (hereinafter the phenomenon being referred to as "crosstalk") occurs in a panel having the electrode structure of Patent Literature 2. It is also found that this crosstalk can cause an abnormal sustain discharge. Such an abnormal sustain discharge degrades the image display quality.

CITATION LIST

Patent Literature

[PTL1]
Japanese Patent Unexamined Publication No. 2006-18298
[PTL2]
Japanese Patent Unexamined Publication No. H08-212933

SUMMARY OF INVENTION

A plasma display device includes the following elements:

a panel,

- the panel being driven by a subfield method in which a plurality of subfields are disposed in one field, each of the subfields having an initializing period, an address period, and a sustain period,
- the panel having a plurality of discharge cells, each of the discharge cells having a display electrode pair formed of a scan electrode and a sustain electrode,
- the scan electrodes and the sustain electrodes being arranged so that the positions of the scan electrode and the sustain electrode are alternately interchanged in each display electrode pair; and an image signal processing circuit for converting an image signal into image data that indicates light emission and no light emission in each subfield in each of the discharge cells.

The image signal processing circuit generates the image data so that a combination of the image data is avoided. The combination is such that one of two adjacent discharge cells is lit and the other of the discharge cells is unlit in one subfield of the plurality of subfields forming the one field, and the one of the discharge cells is unlit and the other of the discharge cells is lit in a subfield after the one subfield in the same field.

With this structure, in the panel that has scan electrodes and sustain electrodes arranged so that the positions of the corresponding scan electrode and sustain electrode is alternately interchanged in each display electrode pair, crosstalk between the adjacent discharge cells can be reduced. Thus this structure can cause a sustain discharge stably, and improve the image display quality.

BRIEF DESCRIPTION OF DRAWINGS

FIG. 6A is a chart showing an example of a coding table where gradations for display are correlated with coding data at respective gradation values in accordance with the first exemplary embodiment.

FIG. 6B is a chart showing the example of the coding table where gradations for display are correlated with coding data at respective gradation values in accordance with the first exemplary embodiment.

FIG. 8A is a chart showing an example of a combination of image data that easily causes crosstalk between adjacent discharge cells in accordance with the first exemplary embodiment.

FIG. 8B is a chart showing an example of a combination of image data that easily causes crosstalk between the adjacent discharge cells in accordance with the first exemplary embodiment.

FIG. 8C is a chart showing an example of a combination of image data that easily causes crosstalk between the adjacent discharge cells in accordance with the first exemplary embodiment.

FIG. 9A is a chart showing an example of altering image data so that crosstalk-causing conditions are avoided in accordance with the first exemplary embodiment.

FIG. 9B is a chart showing an example of altering image data so that the crosstalk-causing conditions are avoided in accordance with the first exemplary embodiment.

FIG. 10 is a chart showing an example of altering image data so that the crosstalk-causing conditions are avoided in accordance with the first exemplary embodiment.

FIG. 11A is a chart showing yet another example of altering image data so that the crosstalk-causing conditions are avoided in accordance with the first exemplary embodiment.

FIG. 11B is a chart showing still another example of altering image data so that the crosstalk-causing conditions are avoided in accordance with the first exemplary embodiment.

FIG. 12A is a chart showing still another example of altering image data so that the crosstalk-causing conditions are avoided in accordance with the first exemplary embodiment.

FIG. 12B is a chart showing still another example of altering image data so that the crosstalk-causing conditions are avoided in accordance with the first exemplary embodiment.

FIG. 14 is a chart showing still another example of altering image data so that the crosstalk-causing conditions are avoided in accordance with the first exemplary embodiment.

FIG. 16 is a chart showing an example of a second coding table where gradations for display are correlated with coding data at respective gradation values in accordance with the second exemplary embodiment.

FIG. 20C is a chart schematically showing the example of altering the dither processing.

FIG. 23C is a chart schematically showing the still another example of the dither processing.

DESCRIPTION OF EMBODIMENTS

Hereinafter, a plasma display device in accordance with exemplary embodiments of the present invention will be described with reference to the accompanying drawings.

Example 1

Figure 1:
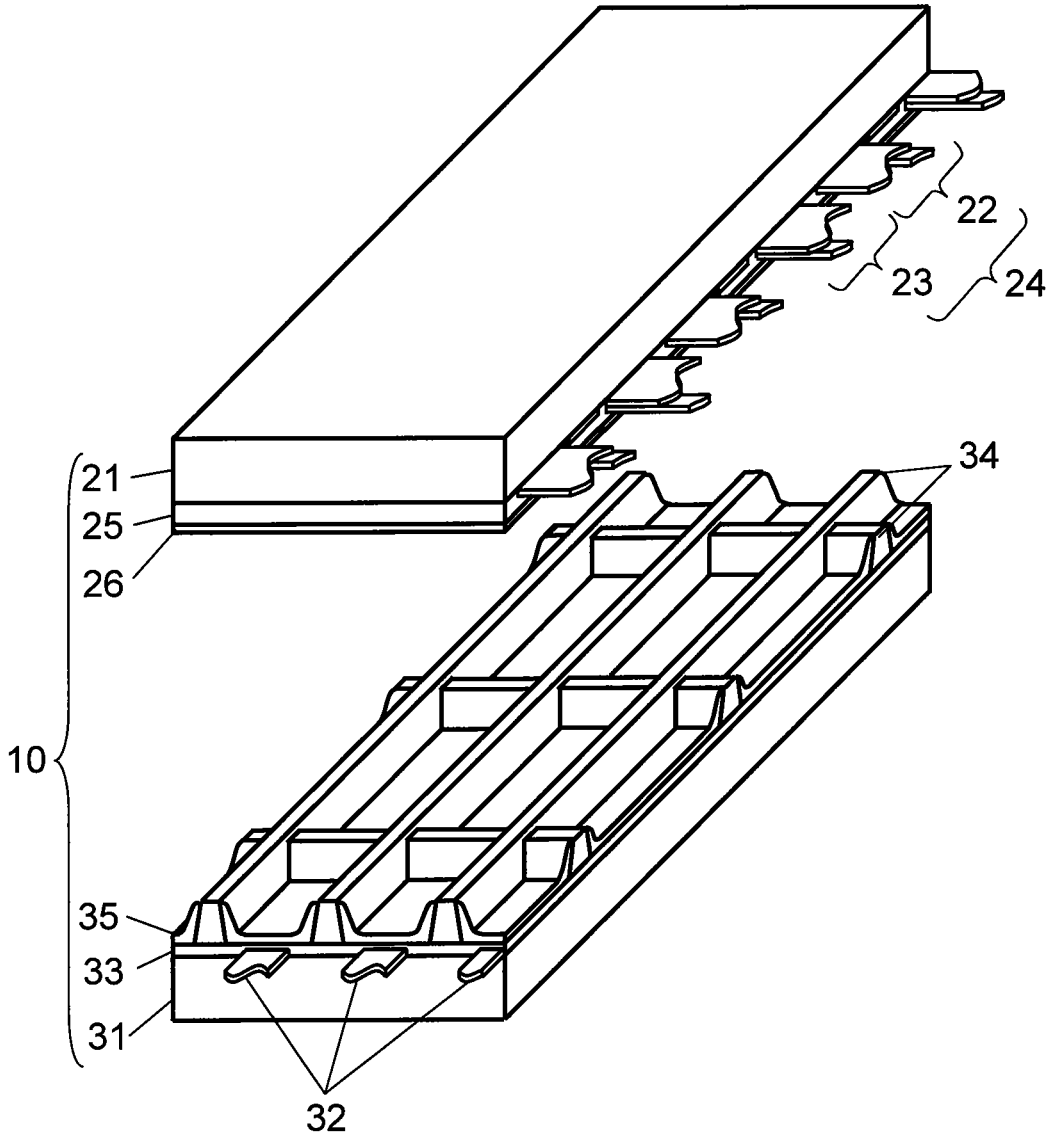
FIG. 1 is an exploded perspective view showing a structure of a panel in accordance with a first exemplary embodiment of the present invention.

FIG. 1 is an exploded perspective view showing a structure of panel 10 in accordance with the first exemplary embodiment of the present invention. A plurality of display electrode pairs 24, each formed of scan electrode 22 and sustain electrode 23, are disposed on glass front plate 21. Dielectric layer 25 is formed so as to cover scan electrodes 22 and sustain electrodes 23. Protective layer 26 is formed over dielectric layer 25.

In order to lower a breakdown voltage in discharge cells, protective layer 26 is made of a material predominantly composed of MgO. MgO has proven performance as a panel material, and exhibits a large secondary electron emission coefficient and excellent durability when neon (Ne) and xenon (Xe) gas is sealed into the panel.

A plurality of data electrodes 32 are formed on rear plate 31. Dielectric layer 33 is formed so as to cover data electrodes 32. Further, mesh barrier ribs 34 are formed on dielectric layer 33. On the side faces of barrier ribs 34 and on dielectric layer 33, phosphor layers 35 for emitting light of red (R), green (G), and blue (B) are formed.

Front plate 21 and rear plate 31 face each other so that display electrode pairs 24 intersect with data electrodes 32 with a small discharge space sandwiched between the electrodes. The outer peripheries of the plates are sealed with a sealing material, e.g. a glass frit. Into the inside discharge space, a mixed gas of neon and xenon is sealed as a discharge gas. In this exemplary embodiment, a discharge gas having a xenon partial pressure of approximately 10% is used to improve the emission efficiency. The discharge space is partitioned into a plurality of compartments by barrier ribs 34. Discharge cells are formed in intersecting parts between display electrode pairs 24 and data electrodes 32. The discharge cells discharge and emit light to display an image.

The structure of panel 10 is not limited to the above, and the panel may have barrier ribs formed in a stripe pattern. The mixing ratio of the discharge gas is not limited to the above-described value, and other mixing ratios may be used.

Figure 2:
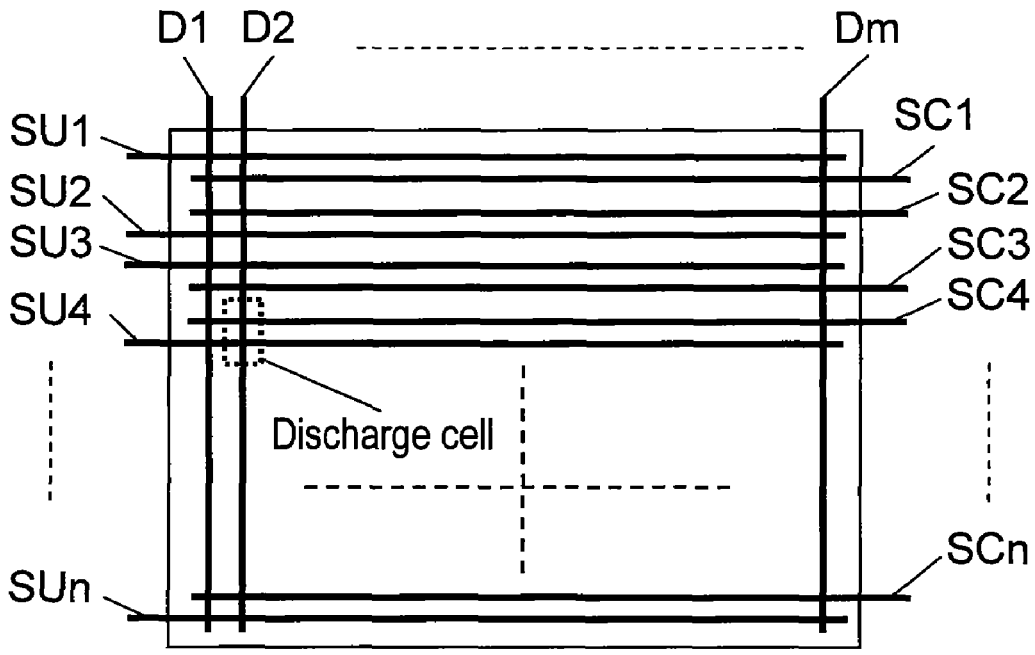
FIG. 2 is an electrode array diagram of the panel.

FIG. 2 is an electrode array diagram of panel 10 in accordance with the first exemplary embodiment of the present invention. Panel 10 has n scan electrode SC1 through scan electrode SCn (scan electrodes 22 in FIG. 1) and n sustain electrode SU1 through sustain electrode SUn (sustain electrodes 23 in FIG. 1) both long in the row direction, and m data electrode D1 through data electrode Dm (data electrodes 32 in FIG. 1) long in the column direction. A discharge cell is formed in the part where a pair of scan electrode SCi (i being 1 through n) and sustain electrode SUi intersects with one data electrode Dj (j being 1 through m). Thus m×n discharge cells are formed in the discharge space. The area where m×n discharge cells are formed is the display area of panel 10.

In panel 10, scan electrode SC1 through scan electrode SCn and sustain electrode SU1 through sustain electrode SUn are arranged so that the positions of the corresponding scan electrode and sustain electrode are alternately interchanged in each display electrode pair 24. Specifically, the electrodes are arranged in the order of a scan electrode, a scan electrode, a sustain electrode, a sustain electrode, a scan electrode, a scan electrode, a sustain electrode, a sustain electrode, and so on. (Hereinafter, such an electrode array is referred to as "ABBA electrode structure". For comparison, the electrode structure described below is referred to as "ABAB electrode structure". In this structure, scan electrode SC1 through scan electrode SCn and sustain electrode SU1 through sustain electrode SUn are arranged so that the positions of the corresponding scan electrode and sustain electrode are not interchanged in each display electrode pair 24. The electrodes are arranged in the order of a scan electrode, a sustain electrode, a scan electrode, a sustain electrode, and so on.)

As shown in FIG. 1 and FIG. 2, scan electrode SCi and sustain electrode SUi are formed parallel to each other in pairs. Thus inter-electrode capacitance Cp exists between scan electrode SC1 through scan electrode SCn and sustain electrode SU1 through sustain electrode SUn. However, in this exemplary embodiment, panel 10 has an ABBA electrode structure, and thus the voltage in adjacent discharge cells can be changed in phase with each other in the sustain operation in sustain periods. Therefore, the reactive power when panel 10 is driven can be reduced.

Figure 3:
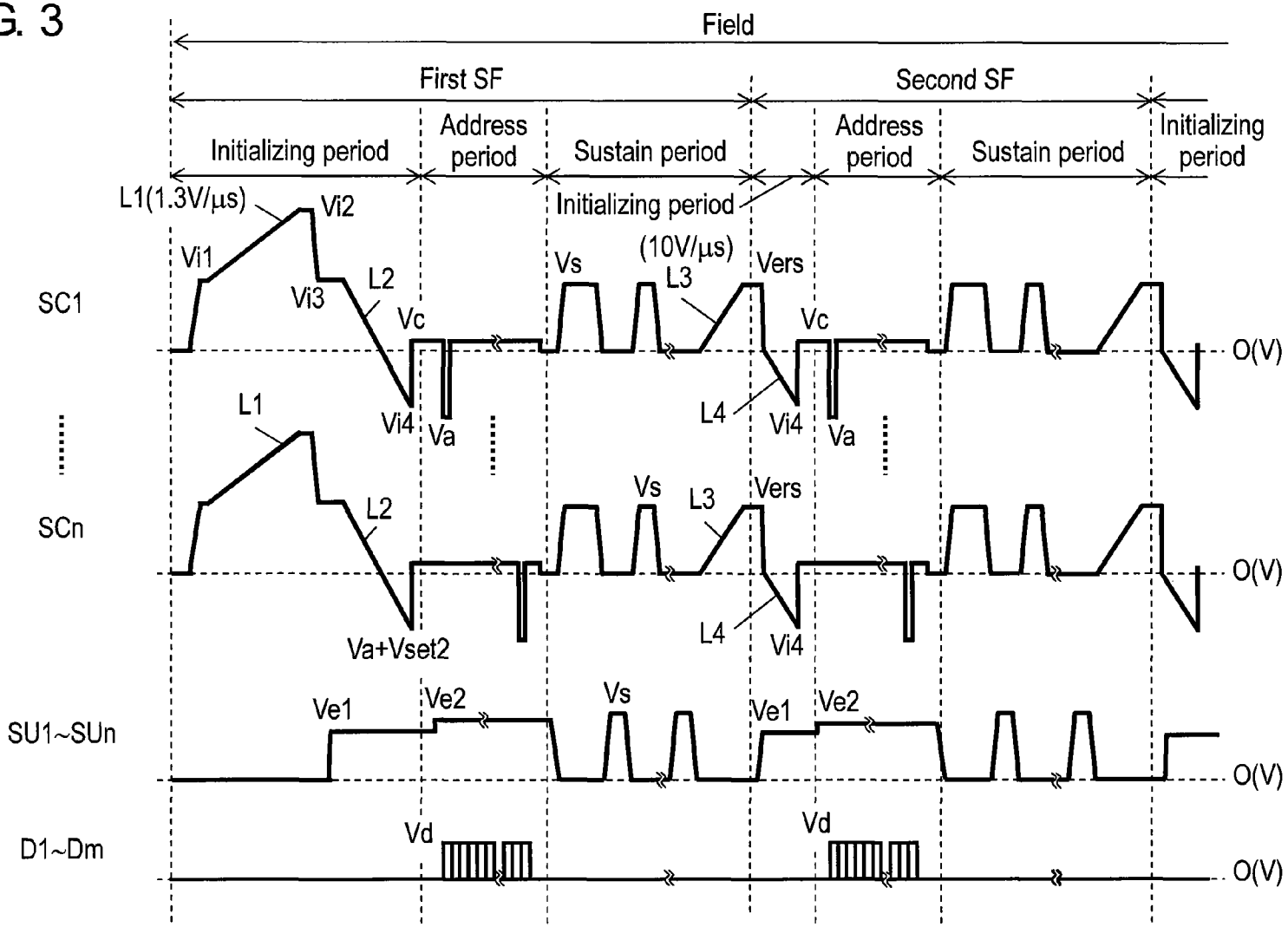
FIG. 3 is a waveform chart of driving voltages applied to the respective electrodes of the panel.

Next, driving voltage waveforms for driving panel 10 and the operation thereof are outlined with reference to FIG. 3. In a plasma display device of this exemplary embodiment, panel 10 is driven by a subfield method. In this subfield method, one field is divided into a plurality of subfields along a time axis, a luminance weight is set for each subfield. Further, emission and no light emission of each discharge cell are controlled in each subfield (SF), so that gradation is displayed.

In this subfield method, one field is formed of eight subfields (the first SF, and second SF through eighth SF), and the respective subfields have luminance weights of 1, 2, 4, 8, 16, 30, 57, and 108, for example. In each subfield, sustain pulses equal in number to the luminance weight multiplied by a predetermined luminance magnification are generated. Thus the brightness of the image is adjusted by controlling the number of light emissions in sustain periods. In the initializing period of one of the plurality of subfields, an all-cell initializing operation for causing an initializing discharge in all the discharge cells is performed. In the initializing periods of the other subfields, a selective initializing operation for causing an initializing discharge selectively in the discharge cells having undergone a sustain discharge in the immediately preceding subfields is performed. Thus light emission unrelated to gradation display can be minimized and the contrast ratio can be improved.

In this exemplary embodiment, an all-cell initializing operation is performed in the initializing period of the first SF. In the initializing periods of the second SF through the eighth SF, a selective initializing operation is performed. With these operations, light emission unrelated to image display is only the light emission caused by the discharge in the all-cell initializing operation in the first SF. Thus luminance of black level, i.e. luminance of an area displaying a black picture in which no sustain discharge is caused, is determined only by weak light emission in the all-cell initializing operation. Therefore, an image having a high contrast can be displayed. In the sustain period of each subfield, sustain pulses equal in number to the luminance weight of the subfield multiplied by a predetermined luminance magnification are applied to each display electrode pair 24.

In the present invention, the number of subfields, and the luminance weights of the respective subfields are not limited to the above-described values of this exemplary embodiment. Further, the present invention is not limited to the subfield structure where luminance weights are arranged in ascending order. For example, the subfield structure where the luminance weights are arranged in descending order can be used. The other subfield structures described below can also be used. In a subfield structure, subfields having luminance weights in ascending order and the subfields having luminance weights in descending order are alternately arranged. In a structure, the subfield structure is changed according to image signals, for example.

FIG. 3 is a waveform chart of driving voltages applied to the respective electrodes of panel 10 in accordance with the first exemplary embodiment of the present invention.

FIG. 3 shows driving waveforms of scan electrode SC1 scanned first in an address period, scan electrode SCn (e.g. scan electrode SC1080) scanned last in the address period, sustain electrode SU1 through sustain electrode SUn, and data electrode D1 through data electrode Dm.

FIG. 3 shows driving voltage waveforms in two subfields: the first subfield (first SF) in which an all-cell initializing operation is performed (hereinafter referred to as "all-cell initializing subfield"); and the second subfield (second SF) in which a selective initializing operation is performed (hereinafter, "selective initializing subfield"). The driving voltage waveforms in the other subfields are substantially the same as the driving voltage waveforms in the second SF, except that the numbers of sustain pulses generated in the sustain periods are different. Scan electrode SCi, sustain electrode SUi, and data electrode Dk in the following descriptions represent the electrodes selected from the corresponding electrodes, according to image data.

First, a description is provided of the first SF, which is an all-cell initializing subfield.

In the first half of the initializing period of the first SF, 0 (V) is applied to each of data electrode D1 through data electrode Dm and sustain electrode SU1 through sustain electrode SUn. To scan electrode SC1 through scan electrode SCn, a voltage rising from 0 (V) to Vi1 is applied, and ramp waveform voltage L1 gradually rising from voltage Vi1 toward Vi2 (hereinafter referred to as "up-ramp waveform") is further applied. Here, voltage Vi1 is equal to or lower than a breakdown voltage, and voltage Vi2 exceeds the breakdown voltage, with respect to sustain electrode SU1 through sustain electrode SUn.

While this up-ramp waveform L1 is rising, a weak initializing discharge continuously occurs between scan electrode SC1 through scan electrode SCn and sustain electrode SU1 through sustain electrode SUn, and between scan electrode SC1 through scan electrode SCn and data electrode D1 through data electrode Dm, respectively. Then, negative wall voltage accumulates on scan electrode SC1 through scan electrode SCn. Positive wall voltage accumulates on data electrode D1 through data electrode Dm and sustain electrode SU1 through sustain electrode SUn. The wall voltage on the electrodes represents the voltage generated by the wall charge that is accumulated on the dielectric layers covering the electrodes, the protective layer, the phosphor layers, or the like.

In the second half of the initializing period, positive voltage Ve1 is applied to sustain electrode SU1 through sustain electrode SUn, and 0 (V) is applied to data electrode D1 through data electrode Dm. To scan electrode SC1 through scan electrode SCn, down-ramp waveform voltage L2 gradually falling from voltage Vi3 toward negative voltage Vi4 (hereinafter, "down-ramp waveform") is applied. Here, voltage Vi3 is equal to or lower than the breakdown voltage and voltage Vi4 exceeds the breakdown voltage, with respect to sustain electrode SU1 through sustain electrode SUn.

During this application, a weak initializing discharge occurs between scan electrode SC1 through scan electrode SCn and sustain electrode SU1 through sustain electrode SUn, and between scan electrode SC1 through scan electrode SCn and data electrode D1 through data electrode Dm, respectively. This weak discharge reduces the negative wall voltage on scan electrode SC1 through scan electrode SCn, and the positive wall voltage on sustain electrode SU1 through sustain electrode SUn. This weak discharge also adjusts the positive wall voltage on data electrode D1 through data electrode Dm to a value appropriate for the address operation. In this manner, the all-cell initializing operation for causing the initializing discharge in all the discharge cells is completed.

In the subsequent address period, a scan pulse voltage is applied sequentially to scan electrode SC1 through scan electrode SCn. Positive address pulse voltage Vd is applied to data electrode Dk (k being 1 through m) corresponding to a discharge cell to be lit, among data electrode D1 through data electrode Dm. Thus an address discharge is caused selectively in the corresponding discharge cells.

In this address period, first, voltage Ve2 is applied to sustain electrode SU1 through sustain electrode SUn, and voltage Vc (Vc=Va+Vscn) is applied to scan electrode SC1 through scan electrode SCn.

Next, negative scan pulse voltage Va is applied to scan electrode SC1 in the first row, and positive address pulse voltage Vd is applied to data electrode Dk (k being 1 through m) of the discharge cell to be lit in the first row, among data electrode D1 through data electrode Dm. At this time, the voltage difference in the intersecting part between data electrode Dk and scan electrode SC1 is obtained by adding the difference in an externally applied voltage (Vd−Va) to the difference between the wall voltage on data electrode Dk and the wall voltage on scan electrode SC1, and thus exceeds the breakdown voltage. Then, a discharge occurs between data electrodes Dk and scan electrode SC1. Because voltage Ve2 is applied to sustain electrode SU1 through sustain electrode SUn, the voltage difference between sustain electrode SU1 and scan electrode SC1 is obtained by adding the difference in an externally applied voltage (Ve2−Va) to the difference between the wall voltage on sustain electrode SU1 and the wall voltage on scan electrode SC1. At this time, setting voltage Ve2 to a value slightly lower than the breakdown voltage can make a state in which a discharge is likely to occur but not actually occurs between sustain electrode SU1 and scan electrode SC1. With this setting, the discharge caused between data electrode Dk and scan electrode SC1 can trigger the discharge between the areas of sustain electrode SU1 and scan electrode SC1 intersecting with data electrode Dk. Thus an address discharge occurs in the discharge cells to be lit. Positive wall voltage accumulates on scan electrode SC1 and negative wall voltage accumulates on sustain electrode SU1. Negative wall voltage also accumulates on data electrode Dk.

In this manner, the address operation is performed to cause the address discharge in the discharge cells to be lit in the first row and to accumulate wall voltages on the corresponding electrodes. On the other hand, the voltage in the intersecting parts between data electrode D1 through data electrode Dm applied with no address pulse voltage Vd and scan electrode SC1 does not exceed the breakdown voltage, and thus no address discharge occurs. The above address operation is sequentially repeated until the operation reaches the discharge cells in the n-th row and the address period is completed.

In the subsequent sustain period, sustain pulses equal in number to the luminance weight multiplied by a predetermined luminance magnification are applied alternately to display electrode pairs 24. Thereby, a sustain discharge is caused in the discharge cells having undergone the address discharge, and the discharge cells are lit.

In this sustain period, first, positive sustain pulse voltage Vs is applied to scan electrode SC1 through scan electrode SCn, and the ground potential as a base potential, i.e. 0 (V), is applied to sustain electrode SU1 through sustain electrode SUn. Then, in the discharge cells having undergone the address discharge, the voltage difference between scan electrode SCi and sustain electrode SUi exceeds the breakdown voltage. This is because the difference between the wall voltage on scan electrode SCi and the wall voltage on sustain electrode SUi is added to sustain pulse voltage Vs.

Then, a sustain discharge occurs between scan electrode SCi and sustain electrode SUi, and ultraviolet light generated at this time causes phosphor layers 35 to emit light. Thus negative wall voltage accumulates on scan electrode SCi, and positive wall voltage accumulates on sustain electrodes SUi. Positive wall voltage also accumulates on data electrode Dk. In the discharge cells having undergone no address discharge in the address period, no sustain discharge occurs and the wall voltage at the completion of the initializing period is maintained.

Subsequently, 0 (V) as the base potential is applied to scan electrode SC1 through scan electrode SCn, and sustain pulse voltage Vs is applied to sustain electrode SU1 to sustain electrode SUn. In the discharge cell having undergone the sustain discharge, the voltage difference between sustain electrode SUi and scan electrode SCi exceeds the breakdown voltage. Thereby, a sustain discharge occurs between sustain electrode SUi and scan electrode SCi again. Thus negative wall voltage accumulates on sustain electrode SUi, and positive wall voltage accumulates on scan electrode SCi. Similarly, sustain pulses equal in number to the luminance weight multiplied by the luminance magnification are applied alternately to scan electrode SC1 through scan electrode SCn and sustain electrode SU1 through sustain electrode SUn to cause a potential difference between the electrodes of each display electrode pair 24. Thus the sustain discharge is continued in the discharge cells having undergone the address discharge in the address period.

At the end of the sustain period, after sustain electrode SU1 through sustain electrode SUn are returned to 0 (V), ramp waveform voltage L3 that rises from 0 (V) as the base potential toward voltage Vers exceeding the breakdown voltage (hereinafter referred to as "erasing ramp waveform") is applied to scan electrode SC1 through scan electrode SCn. Then, a weak discharge (hereinafter, "erasing discharge") occurs between sustain electrode SUi and scan electrode SCi in the discharge cell having undergone the sustain discharge. The charged particles generated by this weak discharge accumulate on sustain electrode SUi and scan electrode SCi as wall charge so as to reduce the voltage difference between sustain electrode SUi and scan electrode SCi. Thus, while the positive wall charge is left on data electrode Dk, the wall voltage on scan electrode SCi and sustain electrode SUi is reduced to the difference between the voltage applied to scan electrode SCi and the breakdown voltage, i.e. a degree of (voltage Vers—the breakdown voltage).

Thereafter, scan electrode SC1 through scan electrode SCn are returned to 0 (V), and the sustain operation in the sustain period is completed.

In the initializing period of the second SF, driving voltage waveforms where the first half of the initializing period of the first SF is omitted are applied to the respective electrodes. That is, voltage Ve1 is applied to scan electrode SU1 through scan electrode SUn, and 0 (V) is applied to data electrode D1 through data electrode Dm. Then, down-ramp waveform L4 gradually falling from a voltage equal to or lower than the breakdown voltage (e.g. 0 (V)) toward negative voltage Vi4 is applied to scan electrode SC1 through scan electrode SCn.

Thereby, in the discharge cells having undergone a sustain discharge in the sustain period of the immediately preceding subfield (the first SF in FIG. 3), a weak initializing discharge occurs. This weak initializing discharge reduces the wall voltage on scan electrode SCi and sustain electrode SUi, and adjusts the wall voltage on data electrode Dk (k being 1 through m) to a value appropriate for the address operation. On the other hand, in the discharge cells having undergone no sustain discharge in the preceding subfield, no discharge occurs, and the state of the wall charge at the completion of the initializing period of the preceding subfield is maintained. In this manner, the initializing operation in the second SF is a selective initializing operation for causing an initializing discharge in the discharge cells having undergone the sustain operation in the sustain period of the immediately preceding subfield.

In the address period of the second SF, driving waveforms similar to those in the address period of the first SF are applied to scan electrode SC1 through scan electrode SCn, sustain electrode SU1 through sustain electrode SUn, and data electrode D1 through data electrode Dm.

In the sustain period of the second SF, similar to the sustain period of the first SF, a predetermined number of sustain pulses are applied alternately to scan electrode SC1 through scan electrode SCn, and sustain electrode SU1 through sustain electrode SUn. Thereby, a sustain discharge is caused in the discharge cells having undergone an address discharge in the address period.

In the subfields of the third SF and thereafter, driving waveforms similar to those in the second SF are applied to scan electrode SC1 through scan electrode SCn, sustain electrode SU1 through sustain electrode SUn, and data electrode D1 through data electrode Dm. However, the numbers of sustain pulses generated in the sustain periods are different.

The above descriptions have outlined the driving voltage waveforms applied to the respective electrodes of panel 10.

In this exemplary embodiment, as described above, panel 10 has the ABBA electrode structure. Thus, in adjacent discharge cells, scan electrode 22 and scan electrode 22 are disposed side by side, and sustain electrode 23 and sustain electrode 23 are disposed side by side. Therefore, in adjacent discharge cells, the sustain pulse voltage can be changed in phase with each other, and the reactive power can be reduced. For example, it is verified that, in this case, the reactive power can be reduced by approximately 25% in comparison to the case of driving a panel having the ABAB electrode structure.

Figure 4:
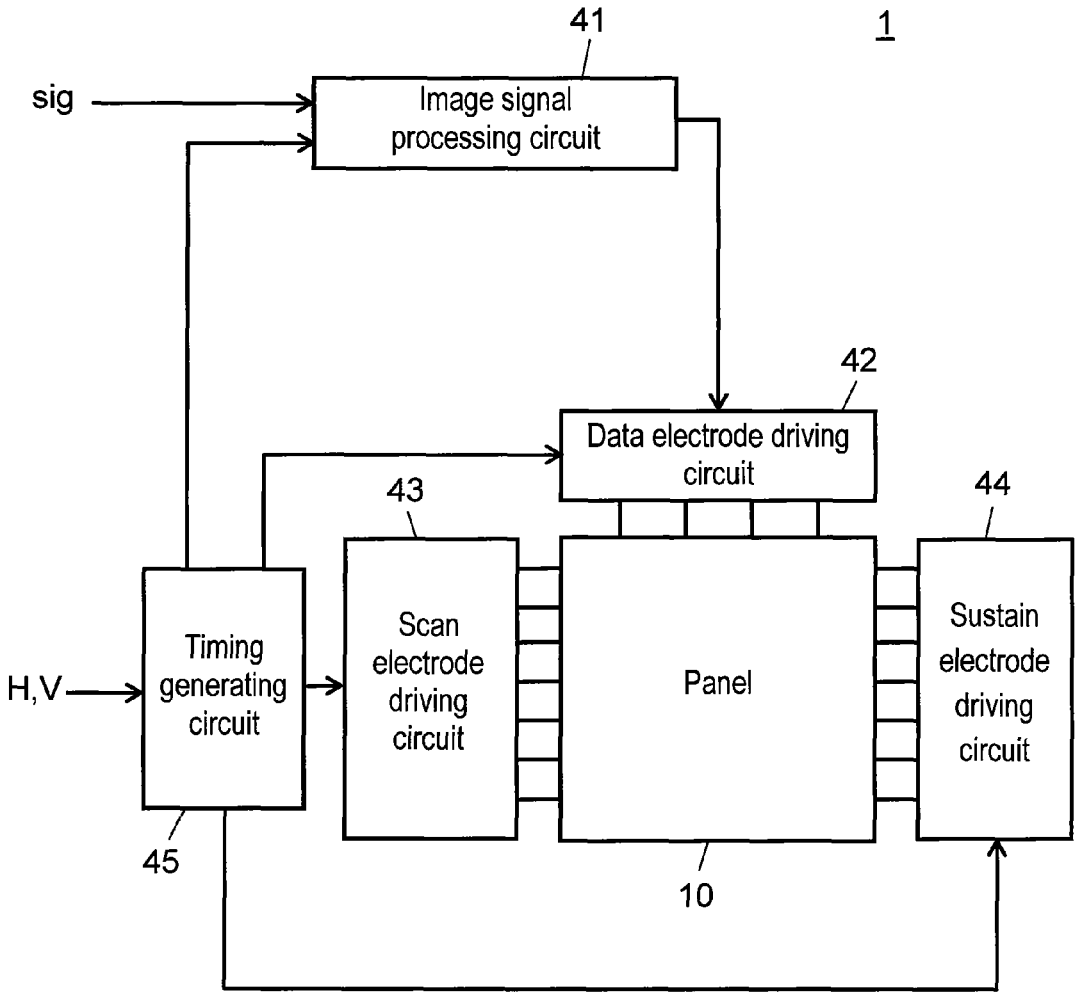
FIG. 4 is a circuit block diagram of a plasma display device in accordance with the first exemplary embodiment.

Next, a structure of a plasma display device in accordance with this exemplary embodiment is described. FIG. 4 is a circuit block diagram of plasma display device 1 in accordance with the first exemplary embodiment of the present invention. Plasma display device 1 has the following elements:

panel 10;
image signal processing circuit 41;
data electrode driving circuit 42;
scan electrode driving circuit 43;
sustain electrode driving circuit 44;
timing generating circuit 45; and
power supply circuits (not shown) for supplying power necessary for the respective circuit blocks.

Image signal processing circuit 41 has a data group (hereinafter referred to as "coding table") that has the following data correlated with each other:

a preset subfield structure (the subfield structure being the number of subfields in one field, and the luminance weights of the respective subfields);

gradation values of the minimum gradation value (e.g. 0) through the maximum gradation value (e.g. 226) set in plasma display device 1; and coding data (data indicating light emission and no light emission in each subfield) set at respective gradation values.

Referring to the coding table and according to the number of pixels of panel 10, the image signal processing circuit converts input image signal sig to image data indicating light emission and no light emission in each discharge cell in each subfield. When the image data of adjacent discharge cells that have scan electrodes 22 disposed side by side satisfies predetermined conditions, image signal processing circuit 41 of this exemplary embodiment further alters the image data. That is, the image signal processing circuit generates image data so that a combination of image data is avoided. The combination is such that one of two adjacent discharge cells is lit and the other of the discharge cells is unlit in one subfield of the plurality of subfields forming one field, and the one of the discharge cells is unlit and the other of the discharge cells is lit in a subfield after the one subfield in the same field. Thus, in plasma display device 1 of this exemplary embodiment, this processing can reduce crosstalk between adjacent discharge cells, prevent occurrence of an abnormal sustain discharge, and improve the image display quality. This processing will be detailed later with reference to the accompanying drawings.

Timing generating circuit 45 generates various timing signals for controlling the operation of the respective circuit blocks according to horizontal synchronizing signal H, and vertical synchronizing signal V, and supplies the timing signals to the respective circuit blocks (image signal processing circuit 41, data electrode driving circuit 42, scan electrode driving circuit 43, and sustain electrode driving circuit 44).

Data electrode driving circuit 42 converts image data in each subfield into signals corresponding to data electrode D1 through data electrode Dm, and drives each of data electrode D1 through data electrode Dm according to the timing signals.

Scan electrode driving circuit 43 has an initializing waveform generating circuit, a scan pulse generating circuit, and a sustain pulse generating circuit (not shown). The initializing waveform generating circuit generates initializing waveforms to be applied to scan electrode SC1 through scan electrode SCn in the initializing periods. The scan pulse generating circuit has a plurality of scan ICs and generates scan pulses to be applied to scan electrode SC1 through scan electrode SCn in the address periods. The sustain pulse generating circuit generates sustain pulses to be applied to scan electrode SC1 through scan electrode SCn in the sustain periods. Scan electrode driving circuit 43 drives each of scan electrode SC1 through scan electrode SCn, according to the timing signals.

Sustain electrode driving circuit 44 has a sustain pulse generating circuit and a circuit (not shown) for generating voltage Ve1 and voltage Ve2, and drives sustain electrodes SU1 through SUn, according to the timing signals.

Figure 5:
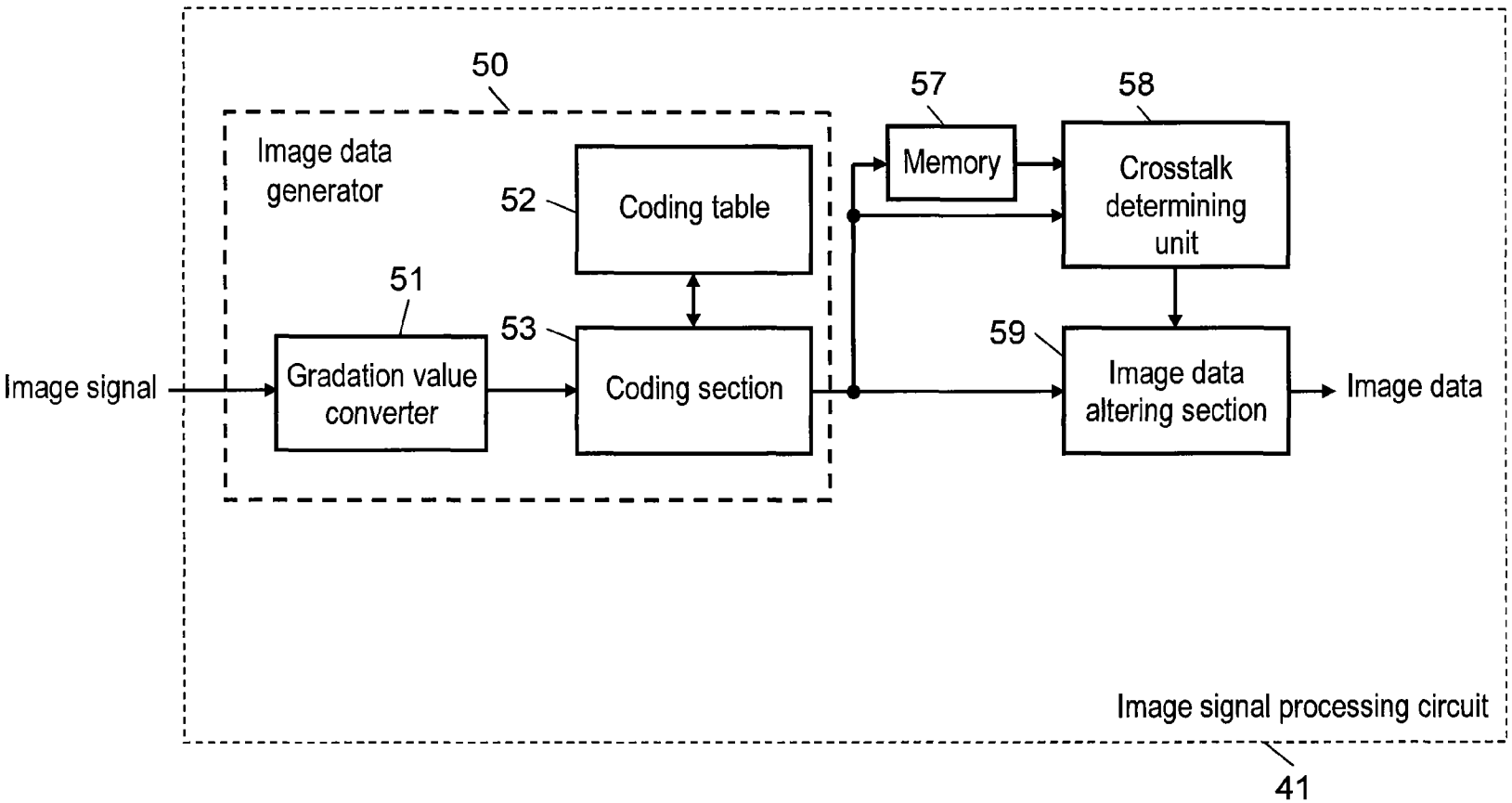
FIG. 5 is a circuit block diagram showing an example of the structure of an image signal processing circuit in accordance with the first exemplary embodiment.

Next, image signal processing circuit 41 is detailed. FIG. 5 is a circuit block diagram showing an example of the structure of image signal processing circuit 41 in accordance with the first exemplary embodiment. In FIG. 5, the circuit blocks related to the control of crosstalk reduction in this exemplary embodiment are shown, and the other circuit blocks are omitted.

Image signal processing circuit 41 has image data generator 50, crosstalk determining unit 58, and image data altering section 59. Image data generator 50 generates image data based on an image signal. Crosstalk determining unit 58 determines whether or not, in the image data output from image data generator 50, image data of two adjacent discharge cells having side-by-side scan electrodes 22 forms a predetermined combination. Image data altering section 59 alters the image data output from image data generator 50 and generates new image data.

Image data generator 50 has coding table 52, gradation value converter 51, and coding section 53. Gradation value converter 51 converts an image signal into a gradation value to be used for display (hereinafter also referred to as "gradation for display") that is included in coding table 52. Coding section 53 reads out coding data from coding table 52, according to the gradation value output from gradation value converter 51, and generates image data.

Coding table 52 is formed of a preset coding table (e.g. the coding table of FIG. 6A and FIG. 6B) stored in an optionally readable memory element, such as a semiconductor memory.

FIG. 6A and FIG. 6B are charts showing an example of a coding table where gradations for display are correlated with coding data at respective gradation values in accordance with the first exemplary embodiment of the present invention. The coding table of FIG. 6A and FIG. 6B is an example of a coding table where one field is formed of eight subfields of the first SF through the eighth SF, and the respective subfields of the first SF through the eighth SF have luminance weights of 1, 2, 4, 8, 16, 30, 57, and 108. In the coding table, a plurality of gradation values for display of the minimum gradation value "1" through the maximum gradation value "226" are correlated with the coding data at the corresponding gradation values.

In FIG. 6A and FIG. 6B, the subfields denoted by "1" are those where addressing is performed, i.e. light-emission subfields; the subfields denoted by "0" are those where no addressing is performed, i.e. no-light-emission subfields.

According to the magnitude of an image signal, gradation value converter 51 selects and outputs one of the gradation values for display included in the coding table of FIG. 6A and FIG. 6B. For example, when an image signal has a magnitude corresponding to the gradation value "45", the gradation value for display "45" is output. Alternatively, when an image signal has a magnitude corresponding to the gradation value "110", the gradation value for display "110" is output. When the coding table of FIG. 6A and FIG. 6B does not include the gradation value for display corresponding to the magnitude of an image signal, a gradation value the nearest to the value is selected and output. For example, when an image signal has a magnitude corresponding to the gradation value "44", the coding table of FIG. 6A and FIG. 6B does not include the gradation value "44", and thus the gradation value for display "45", which is the nearest to the gradation value "44", is selected and output.

Then, according to the gradation value for display output from gradation value converter 51, coding section 53 reads out coding data from coding table 52. When the gradation value for display "45", for example, is output from gradation value converter 51, coding data having the light emission state "1, 1, 1, 1, 0, 1, 0, 0" allocated to the respective subfields of the first SF through the eighth SF is read from coding table 52. When the gradation value for display "110", for example, is output from gradation value converter 51, similarly, the coding data "1, 1, 1, 0, 1, 1, 1, 0" is read out. The read-out coding data is output to the subsequent stage as image data.

In this manner, image data generator 50 generates image data from an image signal. When the gradation value corresponding to the magnitude of the image signal is not included in the gradation values for display, a generally used error diffusion method or a dither method, for example, may be used. (In the error diffusion method, the difference between the image signal and the gradation value selected for display is diffused into the surrounding pixels. In the dither method, using a plurality of different gradation values, another gradation value is displayed in a pseudo manner.) By these methods, the gradation value corresponding to the magnitude of an image signal can be displayed in a pseudo manner. For example, when an image signal has a magnitude corresponding to the gradation value "85", the gradation value "85" is not included in the coding table of FIG. 6A and FIG. 6B as a gradation value for display, and thus cannot be displayed directly on panel 10. However, by the error diffusion method or the dither method, the gradation value "85" can be displayed in a pseudo manner.

Crosstalk determining unit 58 determines, from a current image data and the image data delayed by one horizontal period by memory 57, whether or not the discharge cells to which these image data are allocated are adjacent discharge cells having side-by-side scan electrodes 22. Further, the crosstalk determining unit determines whether or not the current data and the image data delayed by one horizontal period form the predetermined combination. Then, in response to the two determination results in crosstalk determining unit 58, image data altering section 59 alters the image data output from image data generator 50 and generates new image data. Next, this processing is detailed, with reference to the accompanying drawings.

Figure 7:
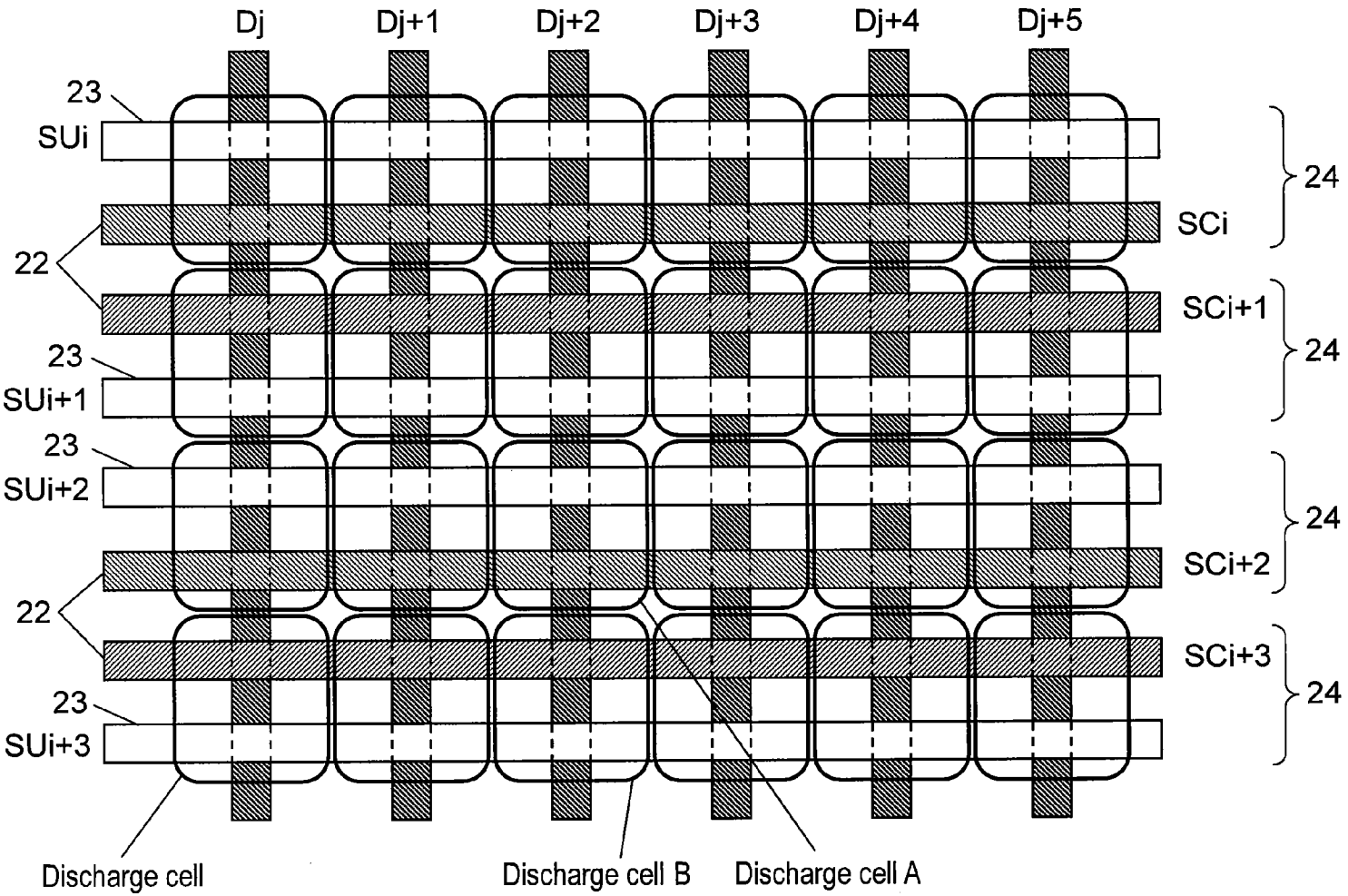
FIG. 7 is a diagram schematically showing the relation between an array of scan electrodes, sustain electrodes, and data electrodes, and discharge cells in accordance with the first exemplary embodiment.

FIG. 7 is a diagram schematically showing the relation between an array of scan electrodes 22, sustain electrodes 23, and data electrodes 32, and discharge cells in accordance with the first exemplary embodiment of the present invention. Because panel 10 of this exemplary embodiment has the ABBA electrode structure, scan electrodes 22 and sustain electrodes 23 are arranged so that the positions of the corresponding scan electrode and sustain electrode are alternately interchanged in each display electrode pair 24. Thus, in the discharge cells vertically adjacent to each other in the drawing, the electrodes of the same type are disposed side by side. Specifically, the discharge cells are adjacent to each other so that scan electrodes 22 are disposed side by side or sustain electrodes 23 are disposed side by side. With this arrangement, in the sustain operation in sustain periods, the voltage of the adjacent discharge cells can be changed in phase with each other. Thus the reactive power when panel 10 is driven can be reduced.

On the other hand, in panel 10 having the ABBA electrode structure, the following phenomenon is also verified: when adjacent discharge cells having side-by-side scan electrodes 22 are lit in a predetermined pattern, crosstalk easily occurs between the adjacent discharge cells. (In the following descriptions, as an example of adjacent discharge cells having side-by-side scan electrodes 22, the discharge cell disposed above is referred to as "discharge cell A", and the discharge cell disposed below is referred to as "discharge cell B". In the following descriptions, the adjacent discharge cells having side-by-side scan electrodes 22 are also simply referred to as "adjacent discharge cells".) Specifically, crosstalk easily occurs when both of the following two conditions are satisfied. The conditions are those where:

1. in one subfield (e.g. the third SF) of a plurality of subfields forming one field, one (e.g. discharge cell A) of adjacent discharge cells is lit, and the other (e.g. discharge cell B) of the discharge cells is unlit; and
2. in a subfield (e.g. one of the fourth SF through the eighth SF) after the above-described one subfield (e.g. the third SF) in the same field, the above-described one (discharge cell A) of the discharge cells is unlit, and the above-described other (discharge cell B) of the discharge cells is lit.

Such a combination of image data easily causes crosstalk between the adjacent discharge cells (herein, between discharge cell A and discharge cell B).

FIG. 8A, FIG. 8B, and FIG. 8C are charts showing examples of combinations of image data that easily cause crosstalk between adjacent discharge cells in accordance with the first exemplary embodiment of the present invention.

Suppose that discharge cell A is lit at the gradation value "196", and discharge cell B is lit at the gradation value "102", for example. At this time, the light emission states in the first SF through the eighth SF according to the coding table of FIG. 6A and FIG. 6B are as follows. As shown in FIG. 8A, discharge cell A is lit in the pattern "1, 1, 1, 1, 1, 0, 1, 1"; discharge cell B is lit in the pattern "1, 1, 1, 1, 0, 1, 1, 0". When discharge cell A and discharge cell B are lit in these light emission patterns, the light emission states are the same in the first SF through the fourth SF. However, in the fifth SF, discharge cell A is lit, and discharge cell B is unlit. In the subsequent sixth SF, conversely, discharge cell A is unlit and discharge cell B is lit. Then, in the sixth SF, an abnormal discharge can be caused by crosstalk in discharge cell A to be unlit.

Suppose that discharge cell A is lit at the gradation value "27", and discharge cell B is lit at the gradation value "102", for example. At this time, the light emission states in the first SF through the eighth SF are as follows. As shown in FIG. 8B, discharge cell A is lit in the pattern "1, 1, 0, 1, 1, 0, 0, 0"; discharge cell B is lit in the pattern "1, 1, 1, 1, 0, 1, 1, 0". In these light emission patterns, discharge cell A is unlit and discharge cell B is lit in the third SF, and conversely, discharge cell A is lit and discharge cell B is unlit in the subsequent fifth SF while the fourth SF where both discharge cell A and discharge cell B are lit is sandwiched between the third SF and the fifth SF. Then, in the fifth SF, an abnormal discharge can be caused by crosstalk in discharge cell B to be unlit.

Suppose that discharge cell A is lit at the gradation value "57", and discharge cell B is lit at the gradation value "196", for example. Then, as shown in FIG. 8C, discharge cell A is unlit and discharge cell B is lit in the third SF, and conversely, discharge cell A is lit and discharge cell B is unlit in the subsequent sixth SF while the fourth SF and the fifth SF are sandwiched between the third SF and the sixth SF. Then, in the sixth SF, an abnormal discharge can be caused by crosstalk in discharge cell B to be unlit.

In this manner, the following phenomenon is verified: when adjacent discharge cells having side-by-side scan electrodes 22 are lit in predetermined light emission patterns, i.e. lit in the patterns satisfying the above-described two conditions, crosstalk can occur between the adjacent discharge cells, causing an abnormal sustain discharge in the discharge cell to be unlit.

This phenomenon is considered to be caused for the reason described below. In panel 10 having the ABBA electrode structure, electrodes of the same type (scan electrode-scan electrode or sustain electrode-sustain electrode) are disposed side by side. Thus the sustain pulses are applied in phase with each other. As a result, an advantage of reducing the reactive power is obtained when panel 10 is driven. On the other hand, in the discharge cells having the ABBA electrode structure, sustain pulses are applied in phase, and thus a difference in electric field between the discharge cells adjacent in the column direction is smaller than that of the discharge cells having the ABAB electrode structure. Therefore, electric charge easily transfers between the adjacent discharge cells.

For example, when discharge cell A is lit and discharge cell B is unlit, crosstalk, i.e. transfer of the electric charge generated by a sustain discharge from discharge A toward discharge cell B, sometimes can occur between discharge cell A and discharge cell B. This electric charge does not transfer to discharge cell B completely, and remains and accumulates between scan electrode 22 of discharge cell A and scan electrode 22 of discharge cell B. Next, in the first sustain operation in the subfield where discharge cell A is unlit and discharge cell B is lit, the sustain discharge occurring in discharge cell B leaks into discharge cell A via the electric charge accumulated between scan electrodes 22. Once a sustain discharge occurs in a discharge cell of panel 10, the sustain discharge continuously occurs thereafter even if the discharge cell has undergone no addressing. Therefore, in discharge cell A, a sustain discharge is triggered by the sustain discharge leaking from discharge cell B even though discharge cell A has undergone no addressing. Consequently, an abnormal sustain discharge is considered to occur in discharge cell A.

Then, in this exemplary embodiment, the combination of image data satisfying the above-described two conditions is set to the predetermined combination. The conditions are those where:

1. one of two adjacent discharge cells having side-by-side scan electrodes 22 is lit, and the other of the discharge cells is unlit, in one subfield of a plurality of subfields forming one field; and
2. the above-described one of the discharge cells is unlit, and the above-described other of the discharge cells is lit, in a subfield after the above-described one subfield in the same field.

The combination of image data satisfying these two conditions is set to the predetermined combination (hereinafter such a combination of image data being referred to as "crosstalk-causing conditions"), and image data is generated so that this predetermined combination is avoided. That is, image data is generated so that the crosstalk-causing conditions are avoided.

Specifically, first, crosstalk determining unit 58 determines whether or not the discharge cell to which the current image data is allocated and the discharge cell to which the image data delayed by one horizontal period by memory 57 is allocated are adjacent discharge cells having side-by-side scan electrodes 22.

For example, when the electrodes of panel 10 are arranged as shown in FIG. 2, the discharge cell in the first position and the discharge cell in the second position from the top are adjacent discharge cells having side-by-side scan electrodes 22. The discharge cell in the second position and the discharge cell in the third position from the top are adjacent discharge cells having side-by-side sustain electrodes 23. Therefore, the discharge cell in the (2N+1)-th position and the discharge cell in the (2N+2)-th position (N being an integer equal to or larger than 0) from the top can be determined to be adjacent discharge cells having side-by-side scan electrodes 22.

Next, whether or not those image data satisfy the crosstalk-causing conditions is determined. For example, this determination can be made by performing an exclusive OR operation on the current image data and the image data delayed by one horizontal period in each subfield, and detecting whether or not there are two or more subfields having the result "1" and the image data are inverted in these subfields.

When the image data satisfying these two conditions is generated, crosstalk determining unit 58 determines that the image data of the two discharge cells having side-by-side scan electrodes 22 is a combination satisfying the crosstalk-causing conditions. Then, image data altering section 59 alters the image data output from image data generator 50 so that the crosstalk-causing conditions are avoided. That is, the image data output from image data generator 50 is altered so that both of the adjacent discharge cells are lit or unlit, in at least one subfield including at least one of the following two subfields. One of the two subfields is a subfield where one of the adjacent discharge cells is lit and the other of the adjacent discharge cells is unlit. The other of the two subfields is a subfield after the subfield in the same field that is the first subfield where the above-described one of the adjacent discharge cells is unlit and the above-described other of the adjacent discharge cells is lit.

FIGS. 9A, 9B, and 10 are charts showing examples of altering image data so that the crosstalk-causing conditions are avoided in accordance with the first exemplary embodiment of the present invention.

Suppose that, as shown in FIG. 9A, image data is generated so that discharge cell A is lit and discharge cell B is unlit in the fifth SF, and conversely, discharge cell A is unlit and discharge cell B is lit in the subsequent sixth SF, for example. In this case, the image data is altered so that discharge cell B is lit in the fifth SF, and discharge cell B is unlit in the sixth SF. This alteration makes both of discharge cell A and discharge cell B lit in the fifth SF, and both of discharge cell A and discharge cell B unlit in the sixth SF. Thus the crosstalk-causing conditions can be avoided.

Suppose that, as shown in FIG. 9B, image data is generated so that discharge cell A is unlit and discharge cell B is lit in the third SF, and conversely, discharge cell A is lit and discharge cell B is unlit in the fifth SF, while the fourth SF where both of discharge cell A and discharge cell B are lit is sandwiched between the third SF and the fifth SF. In this case, the image data is altered so that discharge cell B is unlit in the third SF, and discharge cell B is lit in the fifth SF. This alteration makes both of discharge cell A and discharge cell B unlit in the third SF, and both of discharge cell A and discharge cell B lit in the fifth SF. Thus the crosstalk-causing conditions can be avoided. In FIG. 9B, similar to the fifth SF, discharge cell A is lit and discharge cell B is unlit in the sixth SF. However, the image data is altered so that discharge cell B is unlit in the third SF, and thus the crosstalk-causing conditions can be avoided.

FIG. 10 is a chart showing an example where a plurality of combinations of the subfields satisfying the crosstalk-causing conditions are included in one field. Suppose that, as shown in FIG. 10, image data is generated so that discharge cell A is unlit and discharge cell B is lit in the third SF and the fourth SF, and conversely, discharge cell A is lit and discharge cell B is unlit in the fifth SF and the sixth SF. At this time, even when the image data is altered so that discharge cell B is unlit in the third SF, and discharge cell B is lit in the fifth SF, the fourth SF and the sixth SF satisfy the crosstalk-causing conditions. In this case, the image data is further altered so that discharge cell B is unlit in the fourth SF and discharge cell B is lit in the sixth SF. This alteration makes both of discharge cell A and discharge cell B unlit in the third SF and the fourth SF, and both of discharge cell A and discharge cell B lit in the fifth SF and the sixth SF. Thus the crosstalk-causing conditions can be avoided.

In this manner, image data altering section 59 alters image data so that the crosstalk-causing conditions are avoided. This structure reduces crosstalk between adjacent discharge cells, and prevents an abnormal discharge caused by the crosstalk. Thus image display quality can be improved.

As described above, in this exemplary embodiment, image data is generated so that a combination of image data is avoided. The combination is such that one of two adjacent discharge cells is lit and the other of the discharge cells is unlit in one subfield of a plurality of subfields forming one field, and the above-described one of the discharge cells is unlit and the above-described other of the discharge cells is lit in a subfield after the above-described one subfield in the same field.

In other words, when crosstalk determining unit 58 determines that the image data of two adjacent discharge cells having side-by-side scan electrodes 22 is a combination satisfying the crosstalk-causing conditions, image data altering section 59 alters the image data output from image data generator 50 so that the crosstalk-causing conditions are avoided. That is, the image data output from image data generator 50 is altered so that both of the adjacent discharge cells are lit or unlit, in at least one subfield including at least one of the following two subfields. One of the two subfields is a subfield where one of the two adjacent discharge cells is lit and the other of the discharge cells is unlit. The other of the two subfields is a subfield after the above-described subfield in the same field that is the first subfield where the above-described one of the adjacent discharge cells is unlit and the above-described other of the adjacent discharge cells is lit. This alteration reduces crosstalk between adjacent discharge cells, and prevents an abnormal sustain discharge caused by the crosstalk. Thus image display quality can be improved.

In FIG. 9A and FIG. 9B, a description is provided for examples of the structure where the image data is altered so that, in two adjacent discharge cells, the light emission state of one disposed below (e.g. discharge cell B) becomes the same as the light emission state of one disposed above (e.g. discharge cell A). However, the present invention is not limited to this structure. Though not shown, for example, the image data can be altered so that, in two adjacent discharge cells, the light emission state of one disposed above (e.g. discharge cell A) becomes the same as the light emission state of one disposed below (e.g. discharge cell B). The structure of altering image data so that the light emission state of the discharge cell disposed below (e.g. discharge cell B) becomes the same as the light emission state of the discharge cell disposed above (e.g. discharge cell A) has an advantage. That is, the image data to be used temporally later is altered, and thus the control can be more simplified in comparison to the structure of altering the image data to be used temporally earlier.

In FIG. 9A and FIG. 9B, a description is provided for examples of the structure where image data is altered so that the light emission states of adjacent discharge cells become the same in two subfields satisfying the crosstalk-causing conditions (e.g. two subfields of the fifth SF and the sixth SF in FIG. 9A, and two subfields of the third SF and the fifth SF in FIG. 9B). However, the present invention is not limited to this structure. For example, the image data may be altered so that the light emission pattern of discharge cell B becomes the same as the light emission pattern of discharge cell A. That is, the image data may be altered so that the image data of discharge cell B becomes the same as the image data of discharge cell A. FIG. 11A and FIG. 11B are charts showing yet other examples of altering image data so that the crosstalk-causing conditions are avoided in accordance with the first exemplary embodiment of the present invention.

When crosstalk determining unit 58 determines that the image data of two adjacent discharge cells having side-by-side scan electrodes 22 is a combination satisfying the crosstalk-causing conditions, the image data may be altered in the following manner. That is, as shown in FIG. 11A and FIG. 11B, the image data may be altered so that the light emission pattern of discharge cell B becomes the same as the light emission pattern of discharge cell A. In other words, the image data may be altered so that the image data of discharge cell B becomes the same as the image data of discharge cell A. In the example of FIG. 11A, the image data of discharge cell B is "1, 1, 1, 1, 0, 1, 1, 0"; the image data of discharge cell A is "1, 1, 1, 1, 1, 0, 1, 1". Then, the image data of discharge cell B is altered to "1, 1, 1, 1, 1, 0, 1, 1" so as to become the same as the image data of discharge cell A. Alternatively, in the example of FIG. 11B, the image data of discharge cell B is "1, 1, 1, 1, 0, 1, 1, 0"; the image data of discharge cell A is "1, 1, 0, 1, 1, 0, 0, 0". Then, the image data of discharge cell B is altered to "1, 1, 0, 1, 1, 0, 0, 0" so as to become the same as the image data of discharge cell A. Also with such a structure, the advantage similar to the above can be obtained.

Alternatively, suppose that crosstalk determining unit 58 determines that the image data of two adjacent discharge cells having side-by-side scan electrodes 22 is a combination satisfying the crosstalk-causing conditions, and the crosstalk-causing conditions can be avoided by altering the image data so that both of the two adjacent discharge cells are lit or unlit in one of the two subfields described above. In such a case, the light emission state need not be altered necessarily in a plurality of subfields. FIG. 12A and FIG. 12B are charts showing still other examples of altering image data so that the crosstalk-causing conditions are avoided in accordance with the first exemplary embodiment of the present invention. FIG. 12A is a chart showing an example of altering image data in a subfield disposed temporally earlier in two subfields satisfying the crosstalk-causing conditions. FIG. 12B is a chart showing an example of altering image data in a subfield disposed temporally later in two subfields satisfying the crosstalk-causing conditions.

In the example of FIG. 12A, two subfields satisfying the crosstalk-causing conditions are the third SF and the fifth SF. The crosstalk-causing conditions can be avoided by making the light emission states of discharge cell A and discharge cell B the same in any one of the two subfields. Thus, in this case, the image data may be altered so that the light emission state is changed in either one of the subfields. At this time, when the image data is altered so that the light emission states of discharge cell A and discharge cell B become the same in the subfield having a smaller luminance weight (in the example of FIG. 12A, the third SF disposed temporally earlier), a change in luminance can be suppressed when the image data is altered for crosstalk reduction. Thus the image display quality can be further improved.

In the example of FIG. 12B, two subfields satisfying the crosstalk-causing conditions are the fifth SF and the sixth SF. In this case, even when the light emission states of discharge cell A and discharge cell B are made the same in the fifth SF disposed temporally earlier, the sixth SF and eighth SF still remain as two subfields satisfying the crosstalk-causing conditions. However, when, in the sixth SF disposed temporally later, light emission of discharge cell B is changed to no light emission so that the light emission states of discharge cell A and discharge cell B become the same, the crosstalk-causing conditions can be avoided. In such a case, the image data may be altered so that the light emission states of discharge cell A and discharge cell B become the same in one of the subfields where the crosstalk-causing conditions can be avoided by the alteration (in the example of FIG. 12B, the sixth SF disposed temporally later).

In this exemplary embodiment, a description is provided for a structure where crosstalk determining unit 58 determines, using image data, whether or not the crosstalk-causing conditions are satisfied. However, the combinations of gradation values satisfying the crosstalk-causing conditions may be pre-stored in a storage, for example. With this structure, whether or not the crosstalk-causing conditions are satisfied can be determined, using a gradation value output from gradation value converter 51.

Preferably, the difference from the original gradation value that is generated by altering the image data is corrected by a generally used image processing method, such as a dither method.

Figure 13:
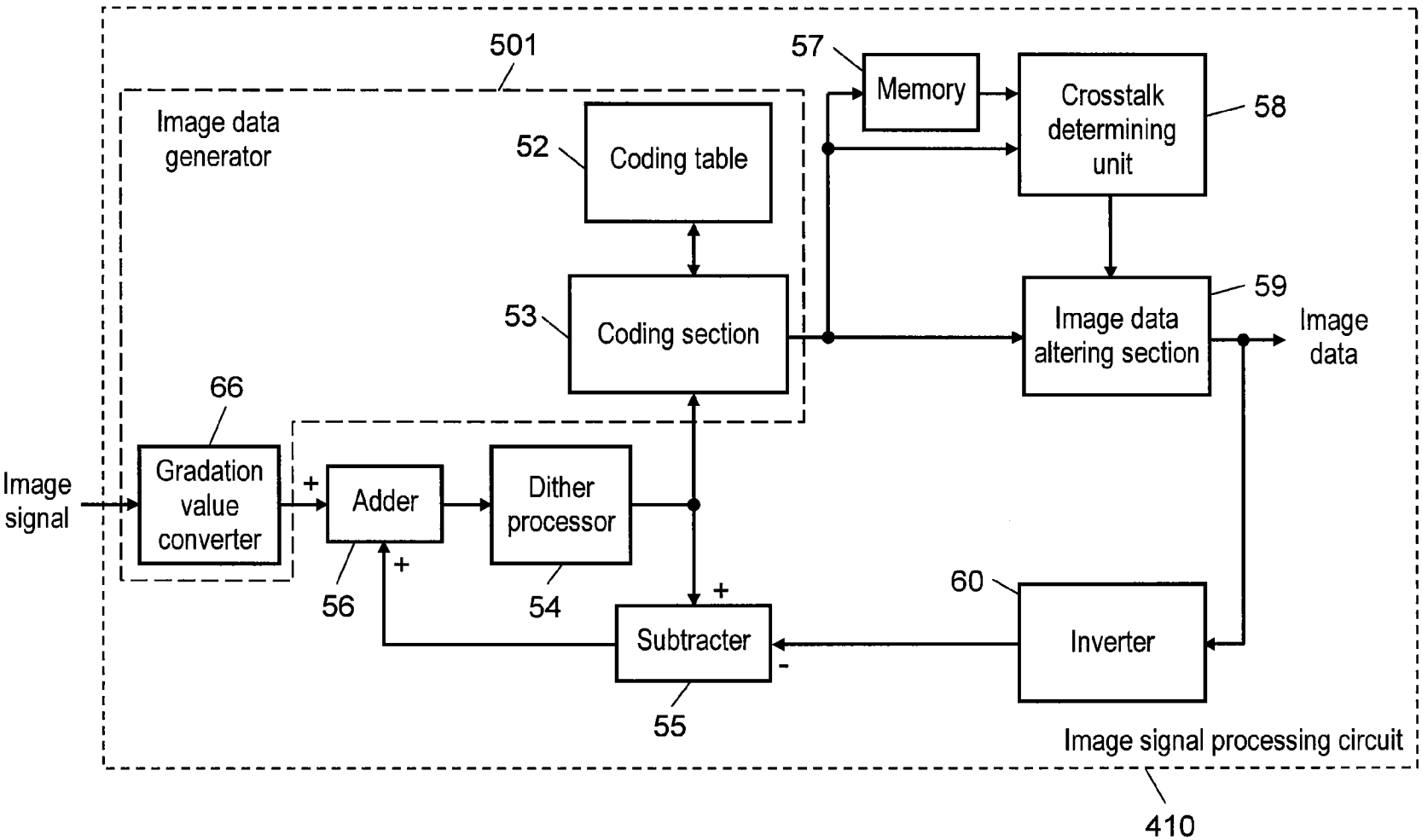
FIG. 13 is a circuit block diagram showing another example of the structure of the image signal processing circuit in accordance with the first exemplary embodiment.

FIG. 13 is a circuit block diagram showing another example of the structure of the image signal processing circuit in accordance with the first exemplary embodiment of the present invention. In FIG. 13, the circuit blocks related to the control of crosstalk reduction are shown, and the other circuit blocks are omitted. Elements similar to those in image signal processing circuit 41 of FIG. 5 have the same reference signs, and the descriptions of those elements are omitted.

Image signal processing circuit 410 has dither processor 54, subtracter 55, adder 56, and inverter 60, in addition to image data generator 501, crosstalk determining unit 58, and image data altering section 59.

Image data generator 501 has coding table 52 and coding section 53 of FIG. 5, and gradation value converter 66. In the above descriptions, gradation value converter 51 of FIG. 5 selects any one of gradation values corresponding to the magnitude of an image signal, among the gradation values for display included in coding table 52. However, gradation value converter 66 of FIG. 13 outputs a gradation value that is optimum for the magnitude of the image signal and not limited by gradations for display because dither processor 54 is disposed at the subsequent stage of this gradation value converter.

Inverter 60 inverts the image data output from image data altering section 59 into a gradation value.

Subtracter 55 calculates the difference between the gradation value output from dither processor 54 and the gradation value output from inverter 60. Therefore, subtracter 55 outputs the difference between the gradation value set according to the image signal and the gradation value according to the image data altered in image data altering section 59.

Adder 56 adds the output value from subtracter 55 to the gradation value output from gradation value converter 66. Therefore, adder 56 outputs a gradation value in which the error generated by altering the image data in image data altering section 59 is corrected with respect to the original gradation value based on the image signal.

Dither processor 54 performs generally known dither processing, i.e. using at least two different gradation values, displaying another gradation value in a pseudo manner. With this processing, a gradation value not included in the gradations for display can be displayed in a pseudo manner, using the gradation values included in the gradations for display.

With this structure, the error generated in image data altering section 59 can be corrected with respect to the original gradation value. Thus the image display quality can be further improved.

When image data is altered so that the image data after the alteration has a gradation value larger than that of the image data before the alteration, the following alteration can be further added. That is, the image data may be further altered so that, in at least one subfield that has a luminance weight smaller than that of the subfield changed from no light emission to light emission by the alteration, light emission is changed to no light emission.

FIG. 14 is a chart showing still another example of altering image data so that the crosstalk-causing conditions are avoided in accordance with the first exemplary embodiment of the present invention. In the example of FIG. 14, the fifth SF in the image data allocated to discharge cell B is changed from a no-light-emission subfield to a light-emission subfield, for example. This change increases the gradation value of discharge cell B. Therefore, in such a case, the image data is further altered so that at least one of the first SF through the fourth SF having luminance weights smaller than that of the fifth SF (in FIG. 14, the first SF, the second SF, and the fourth SF) is changed from light emission to no light emission. This alteration can suppress a change in luminance when the image data is altered for crosstalk reduction. Thus the image display quality can be further improved. However, preferably, the number of subfields to be changed from light emission to no light emission in the subfields having luminance weights smaller than that of the subfield changed from no light emission to light emission is set optimum for the characteristics of the panel.

In this exemplary embodiment, a description is provided for a structure where control for crosstalk reduction is made by setting one field as one unit period. However, it is also verified that the electric charge accumulated between scan electrodes 22, i.e. the cause for crosstalk, is erased by an all-cell initializing operation. Therefore, in a structure where at least two all-cell initializing operations are performed in one field, it is preferable to make control of crosstalk reduction of this exemplary embodiment by setting the period from an all-cell initializing operation to the next all-cell initializing operation as one unit period.

Example 2

Figure 15:
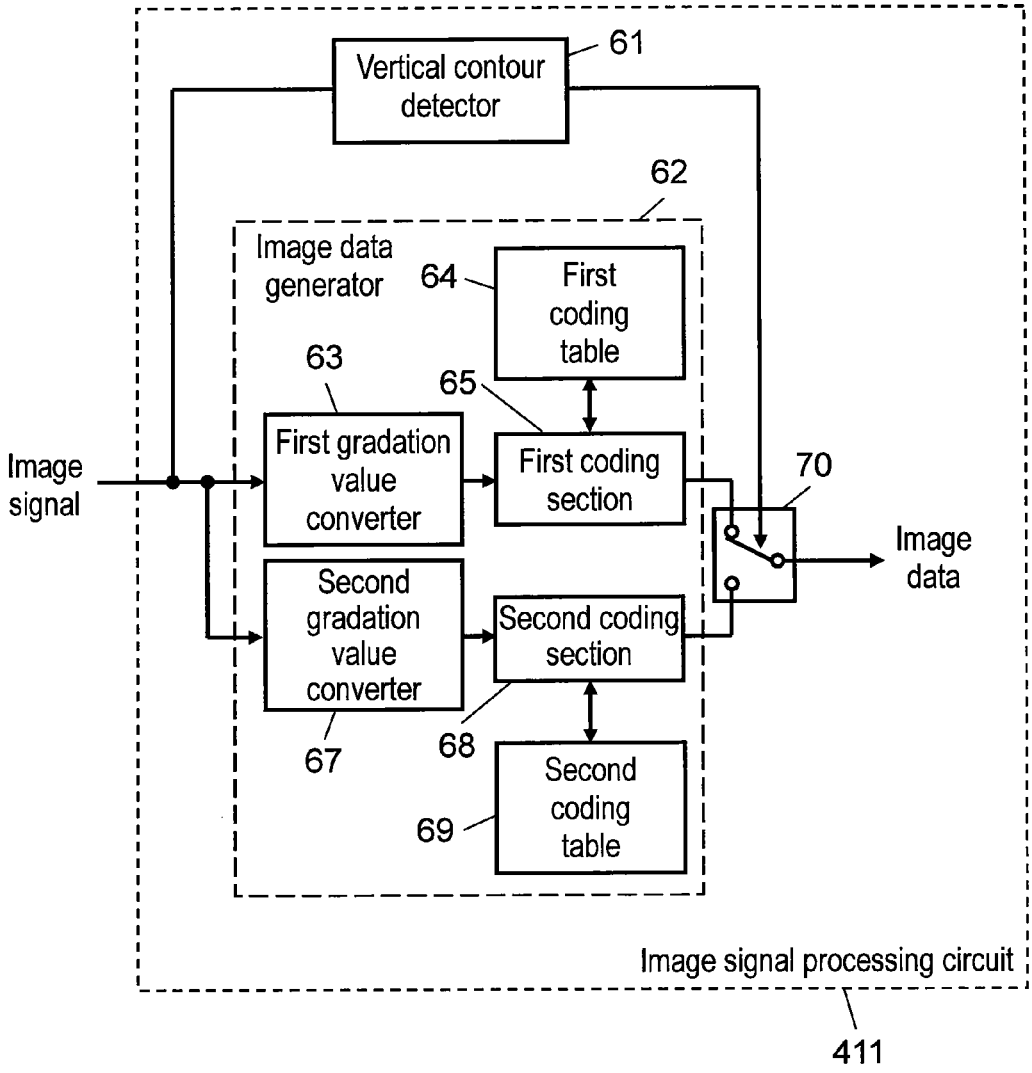
FIG. 15 is a circuit block diagram showing an example of the structure of an image signal processing circuit in accordance with a second exemplary embodiment of the present invention.

FIG. 15 is a circuit block diagram showing an example of the structure of an image signal processing circuit in accordance with the second exemplary embodiment of the present invention.

Image signal processing circuit 411 of FIG. 15 has vertical contour detector 61, image data generator 62, and selector 70.

Vertical contour detector 61 detects a contour portion in the vertical direction (hereinafter referred to as "vertical contour") in an image, and determines whether or not two adjacent discharge cells having side-by-side scan electrodes 22 are included in the vertical contour. For example, a vertical contour can be detected by determining whether or not the absolute value of the difference between a current image signal and the image signal delayed by one horizontal period by a memory (not shown) is equal to or lager than a threshold value set for vertical contour detection. Whether or not the current image signal is allocated to adjacent discharge cells having side-by-side scan electrodes 22 can be determined with a structure similar to that of crosstalk determining unit 58. Thus the descriptions are omitted.

Image data generator 62 has first gradation value converter 63, first coding section 65, first coding table 64, second gradation value converter 67, second coding section 68, and second coding table 69. In this exemplary embodiment, first gradation value converter 63, first coding section 65, and first coding table 64 are similar to gradation value converter 51, coding section 53, and coding table 52 of FIG. 5, respectively, and thus the descriptions of these elements are omitted. However, the structure of first coding table 64 is not limited to the structure similar to that of coding table 52.

FIG. 16 is a chart showing an example of the second coding table where gradations for display are correlated with coding data at respective gradation values in accordance with the second exemplary embodiment of the present invention. The second coding table of FIG. 16 is an example of the coding table where one field is formed of eight subfields of the first SF through the eighth SF, and the respective subfields of the first SF through the eighth SF have luminance weights of 1, 2, 4, 8, 16, 30, 57, and 108.

The second coding table of FIG. 16 is formed of coding data where all the subfields after any no-light-mission subfield in the same field are changed into no light emission. Therefore, the second coding table does not include coding data where a no-light-emission subfield is sandwiched between light-emission subfields or coding data where a light-emission subfield is sandwiched between no-light-emission subfields. Therefore, when the image data allocated to adjacent discharge cells is generated using the coding data included in the second coding table, the crosstalk-causing conditions can be avoided in any combination.

Second gradation value converter 67 selects and outputs any one of the gradation values for display included in the second coding table of FIG. 16, according to the magnitude of the image signal. Then, according to the gradation value output from second gradation value converter 67, second coding section 68 reads out coding data from second coding table 69 and outputs the coding data.

In this manner, image data generator 62 generates two types of image data: image data based on first coding table 64, and image data based on second coding table 69.

Next, in response to the output from vertical contour detector 61, selector 70 selects image data generated according to second coding table 69 when adjacent discharge cells having side-by-side scan electrodes 22 are included in the vertical contour portion. Otherwise, the selector selects image data generated according to first coding table 64. Then, the selected data is output.

In the vertical contour portion, the luminance largely varies. Thus, when crosstalk occurs between the adjacent discharge cells, the variation is easily recognized as large image degradation. However, in this exemplary embodiment, when adjacent discharge cells having side-by-side scan electrodes 22 are included in a vertical contour portion, image data can be generated according to second coding table 69. Thus the crosstalk in a vertical contour portion having a large variation in luminance can be prevented more effectively.

In data electrode driving circuit 42, more power is consumed as the portions where discharge cells to be lit (hereinafter referred to as "lit cells") are adjacent to discharge cells to be unlit (hereinafter, "unlit cells") are increased. However, second coding table 69 is formed of coding data that has successively disposed light-emission subfields and also successively disposed no-light-emission subfields. Thus generating image data using second coding table 69 can reduce the probability that lit cells are adjacent to unlit cells. Therefore, the power consumption in data electrode driving circuit 42 can be reduced. In other words, this exemplary embodiment can also provide an advantage of reducing the power consumption of data electrode driving circuit 42 in vertical contour portions.

Figure 17:
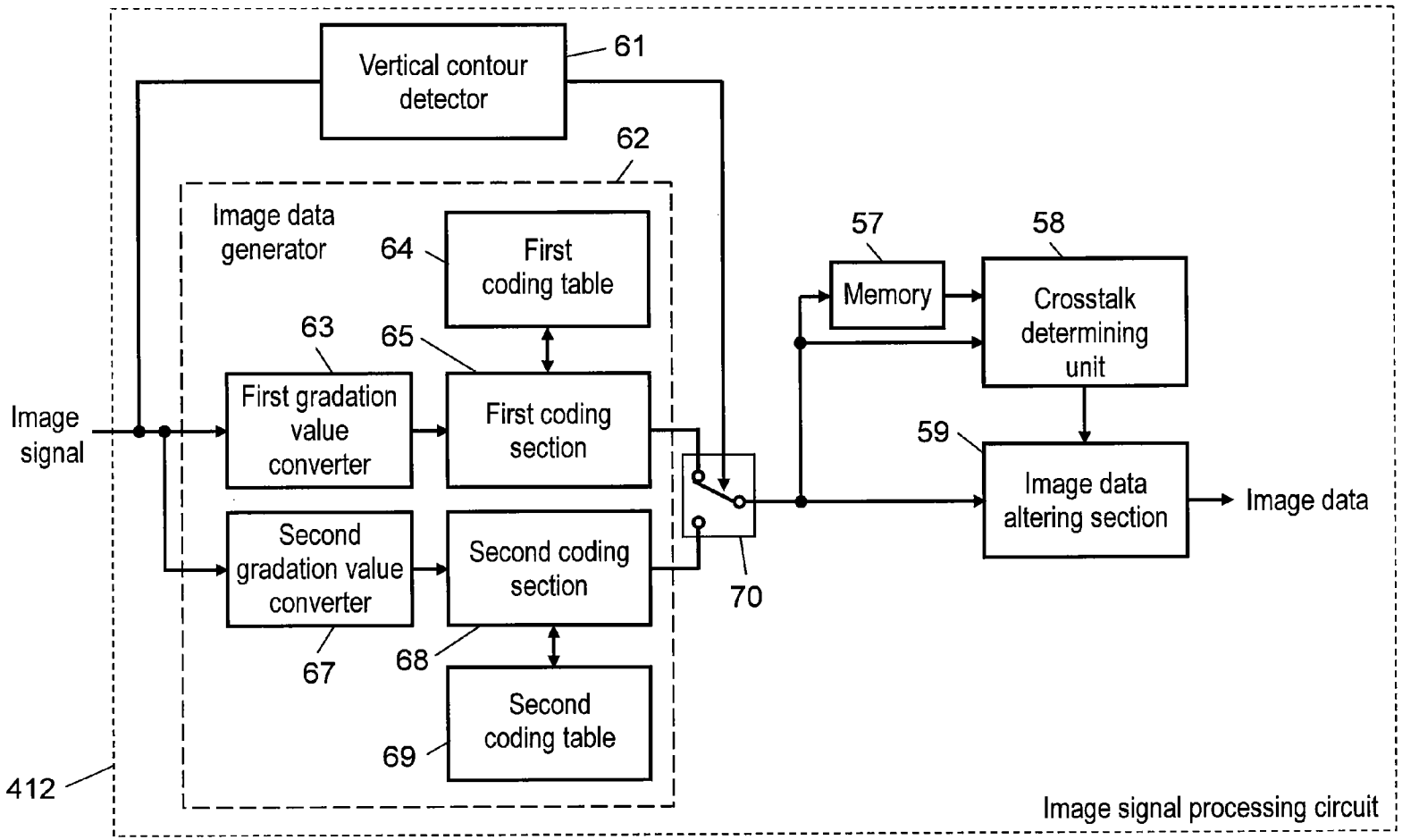
FIG. 17 is a circuit block diagram showing another example of the structure of the image signal processing circuit in accordance with the second exemplary embodiment.

Further, an image signal processing circuit can be configured by combining the structure of this exemplary embodiment with the structure of FIG. 5 in the first exemplary embodiment. FIG. 17 is a circuit block diagram showing another example of the structure of the image signal processing circuit in accordance with the second exemplary embodiment of the present invention. In FIG. 17, the circuit blocks related to the control of crosstalk reduction are shown, and the other circuit blocks are omitted. Elements similar to those in image signal processing circuit 41 of FIG. 5 and those in image signal processing circuit 411 of FIG. 15 have the same reference signs, and the descriptions of those elements are omitted.

Image signal processing circuit 412 has crosstalk determining unit 58, and image data altering section 59 of FIG. 5, and vertical contour detector 61, image data generator 62, and selector 70 of FIG. 15. With such a configuration, the image data of the discharge cells not included in a vertical contour can be altered by the structure of the first exemplary embodiment, and thus the image display quality can be further improved.

Through not shown, an image signal processing circuit can be configured by combining the structure of this exemplary embodiment and the structure of FIG. 13 in the first exemplary embodiment.

Example 3

Figure 18:
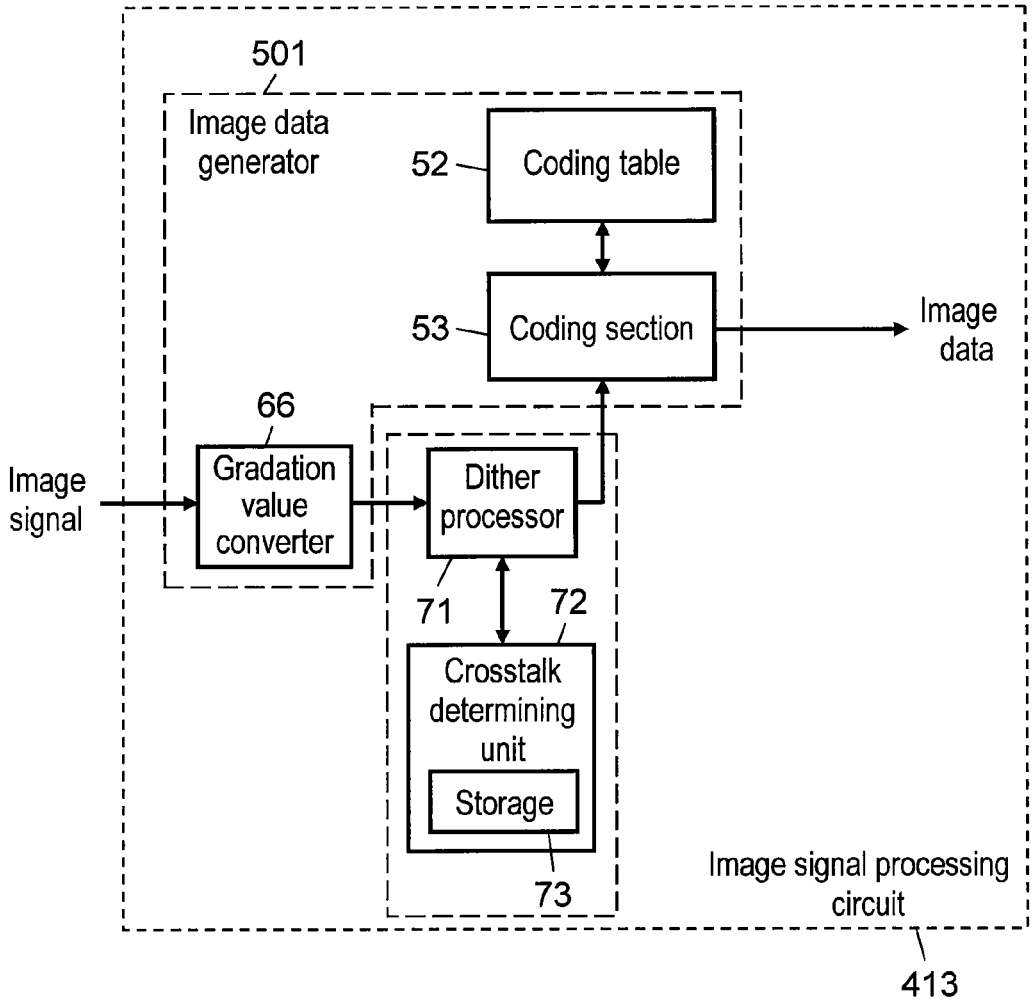
FIG. 18 is a circuit block diagram showing an example of the structure of an image signal processing circuit in accordance with a third exemplary embodiment of the present invention.

FIG. 18 is a circuit block diagram showing an example of the structure of an image signal processing circuit in accordance with the third exemplary embodiment of the present invention. In FIG. 18, the circuit blocks related to the control of crosstalk reduction are shown, and the other circuit blocks are omitted. Elements similar to those in image signal processing circuit 41 of FIG. 5 and those in image signal processing circuit 410 of FIG. 13 have the same reference signs, and the descriptions of those elements are omitted.

Image signal processing circuit 413 has dither processor 71 and crosstalk determining unit 72 in addition to image data generator 501 of FIG. 13.

Similar to gradation value converter 66 of FIG. 13, gradation value converter 66 outputs a gradation value that corresponds to the magnitude of an image signal and is not limited to gradations for display.

When the gradation value output from gradation value converter 51 is not included in the gradations for display, dither processor 71 selects at least two different gradation values among the gradations for display. Then, the dither processor allocates any one of the selected gradation values to each of the plurality of discharge cells combined in matrix (hereinafter referred to as "display cell group"). In this manner, generally known dither processing is performed so that gradation values not included in the gradations for display can be displayed in a pseudo manner. Further, dither processor 71 in this exemplary embodiment alters the dither processing in response to the determination results in crosstalk determining unit 72. This alternation will be detailed later.

In storage 73 of crosstalk determining unit 72, combinations of gradation values satisfying the crosstalk-causing conditions are pre-stored. Then, the crosstalk determining unit determines whether or not the plurality of gradation values selected in dither processor 71 include a combination of gradation values satisfying the crosstalk-causing conditions. Specifically, when the image data converted from the respective two gradation values satisfies both of the following two conditions as shown in FIG. 8A, FIG. 8B, and FIG. 8C, the gradation values are determined to satisfy the crosstalk-causing conditions. The conditions are those where:

1. one subfield of a plurality of subfields forming one field is a light-emission subfield at one of the gradation values, and is a no-light-emission subfield at the other of the gradation values; and
2. the subfields after the above-described one subfield in the same field include a subfield that is a no-light-emission subfield at the above-described one of the gradation values and is a light-emission subfield at the above-described other of the gradation values.

Further, crosstalk determining unit 72 determines whether or not the discharge cell group set in dither processor 71 includes adjacent discharge cells having side-by-side scan electrodes 22.

Figure 19A:
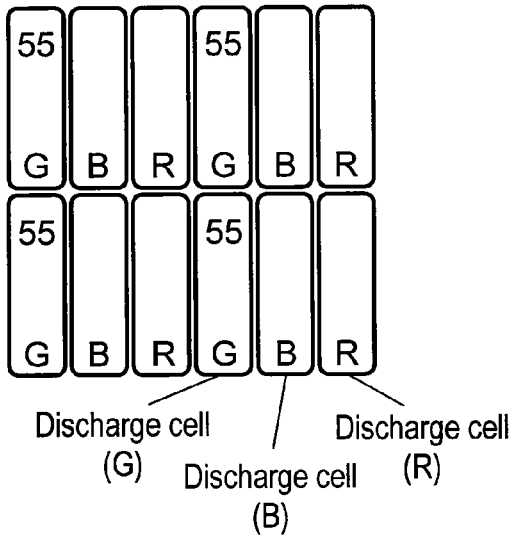
FIG. 19A is a diagram schematically showing an example of dither processing in accordance with the third exemplary embodiment.
Figure 19B:
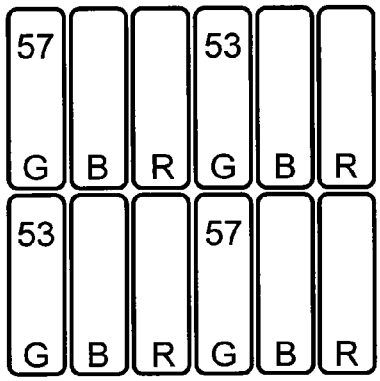
FIG. 19B is a diagram schematically showing the example of the dither processing.
Figure 19C:
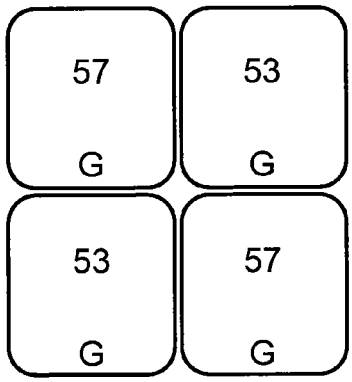
FIG. 19C is a diagram schematically showing the example of the dither processing.

Next, dither processing of this exemplary embodiment is described. FIG. 19A, FIG. 19B, and FIG. 19C are diagrams schematically showing an example of dither processing in accordance with the third exemplary embodiment of the present invention. The respective blocks in FIG. 19A, FIG. 19B, and FIG. 19C represent discharge cells. One denoted by G represents a discharge cell emitting green light, one denoted by B represents a discharge cell emitting blue light, and one denoted by R represents a discharge cell emitting red light. The numerical value in a discharge cell represents a gradation value allocated to the discharge cell.

For example, when G discharge cells are desired to be lit at the gradation value "55" as shown in FIG. 19A, and the gradation value "55" is not included in the gradations for display in coding table 52, a plurality of gradation values are selected from the gradation values included in the gradations for display so as to provide the average value "55". For example, the gradation value "53" and the gradation value "57" are selected. Then, the selected gradation values are allocated to discharge cells combined in matrix (e.g. in two rows and two columns) as shown in FIG. 19B. Thus the gradation value "55" can be displayed in a pseudo manner. At this time, in order to prevent degradation of resolution, the gradation values are allocated to the corresponding discharge cells in the following manner. The discharge cells adjacent in the row direction (hereinafter referred to as "horizontally") have different gradation values. The discharge cells adjacent in the column direction (hereinafter, "vertically") have different gradation values. Actually, in the horizontal direction, a B discharge cell and an R discharge cell are sandwiched between G discharge cells. However, in this exemplary embodiment, the representation "adjacent" is used for ease of explanation.

Dither processor 71 performs such generally known dither processing so that a gradation value not included in the gradations for display (hereinafter also referred to as "intermediate gradation value") can be displayed, using a plurality of gradation values included in gradations for display, in a pseudo manner. Though not shown, by interchanging the gradation values allocated to the corresponding discharge cells in each field, intermediate gradation values can be displayed more naturally.

The dither processing is performed between the discharge cells of the same color, and thus the discharge cells of other colors sandwiched between those of the same color are omitted in the following drawings as shown in FIG. 19C.

Dither processor 71 of this exemplary embodiment alters the above-described dither processing in response to the determination results in crosstalk determining unit 72.

Specifically, when crosstalk determining unit 72 determines that the gradation values selected in dither processor 71 include gradation values satisfying the above-described crosstalk-causing conditions, and the discharge cell group set in dither processor 71 includes adjacent discharge cells having side-by-side scan electrodes 22, dither processor 71 alters dither processing so that the crosstalk-causing conditions are avoided.

That is, dither processor 71 allocates the gradation values selected for dither processing to the respective discharge cells in the discharge cell group so that the adjacent discharge cells having side-by-side scan electrodes 22 have the same gradation value and the adjacent discharge cells having scan electrodes 22 not side-by-side have different gradation values.

Figure 20A:
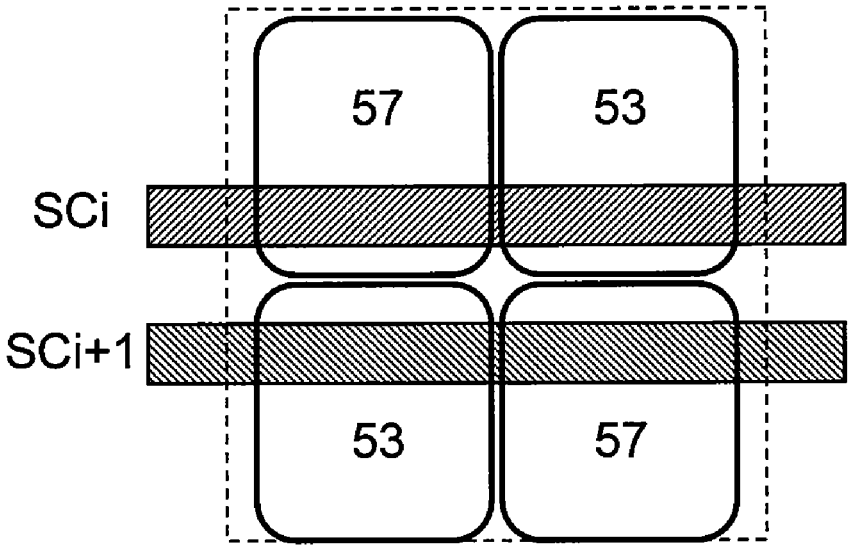
FIG. 20A is a diagram schematically showing an example of altering dither processing in accordance with the third exemplary embodiment.
Figure 20B:
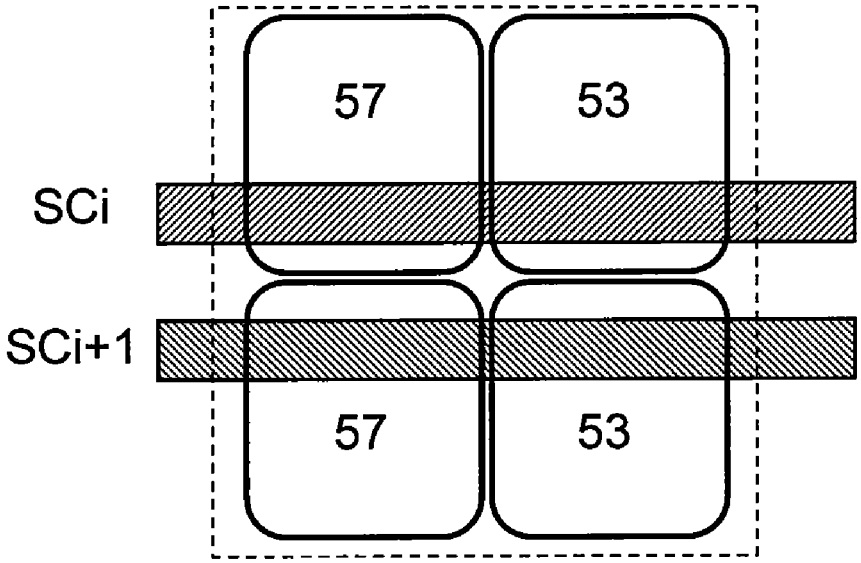
FIG. 20B is a diagram schematically showing the example of altering the dither processing.

FIG. 20A, FIG. 20B, and FIG. 20C are diagrams schematically showing an example of altering dither processing in accordance with the third exemplary embodiment of the present invention. In FIG. 20A and FIG. 20B, for ease of visual understanding of adjacent discharge cells having side-by-side scan electrodes 22, sustain electrodes 23 and data electrodes 32 are omitted, and only the discharge cells and scan electrodes 22 are illustrated. Here, an example of one discharge cell group to be used for dither processing is given. In this example, as shown by the broken line in FIG. 20A, one discharge cell group is formed of four discharge cells combined in matrix of two rows and two columns (hereinafter, discharge cells combined in matrix of n rows and m columns being represented by "nxm discharge cells").

Suppose that, a discharge cell group includes adjacent discharge cells having side-by-side scan electrodes 22, as shown in FIG. 20A, and gradation values selected for dither processing (e.g. the gradation value "53" and the gradation value "57") satisfy the crosstalk-causing conditions, as shown in FIG. 20C. In such a case, dither processor 71 alters dither processing so that the crosstalk-causing conditions are avoided. That is, as shown in FIG. 20B, the allocation of the gradation values to the respective discharge cells is altered so that the adjacent discharge cells having side-by-side scan electrodes 22 have the same gradation value.

Figure 21A:
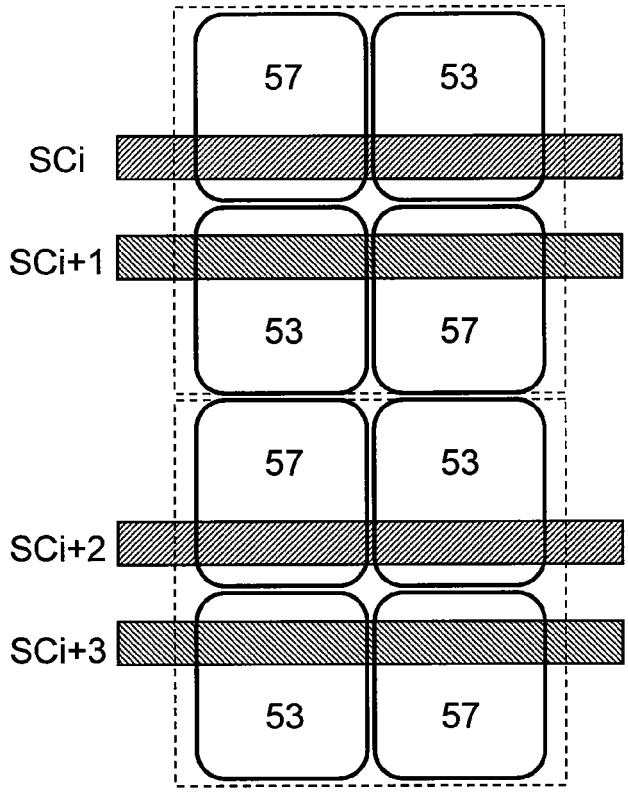
FIG. 21A is a diagram schematically showing another example of dither processing in accordance with the third exemplary embodiment.
Figure 21B:
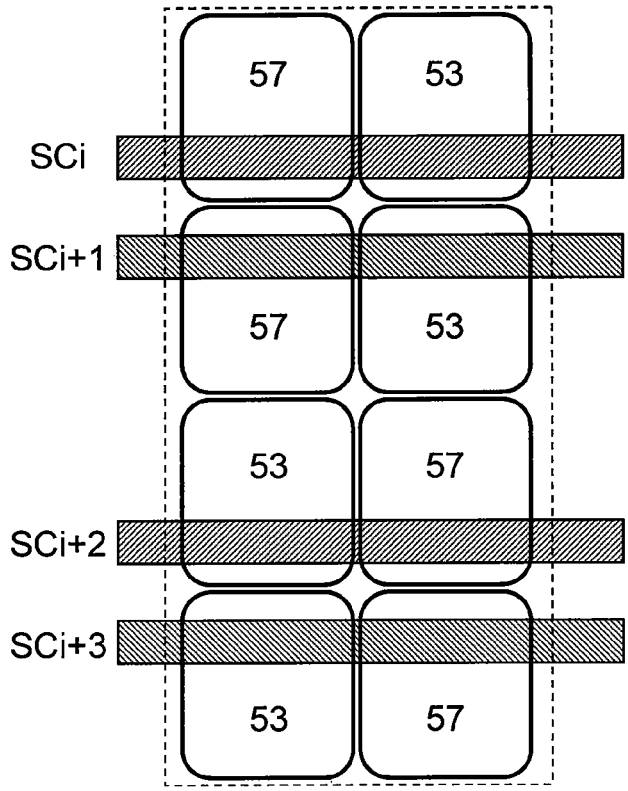
FIG. 21B is a diagram schematically showing the another example of the dither processing.

FIG. 21A and FIG. 21B are diagrams schematically showing another example of the dither processing in accordance with the third exemplary embodiment of the present invention.

Suppose that, as shown in FIG. 21A, a group of 2×2 discharge cells includes adjacent discharge cells having side-by-side scan electrodes 22, gradation values selected for dither processing (e.g. the gradation value "53" and the gradation value "57") satisfy the above-described crosstalk-causing conditions, and further two similar discharge cell groups are adjacent to each other. In such a case, the allocation of the gradation values is altered in the following manner. That is, as shown by the broken line in FIG. 21B, one discharge cell group is set so that four of 2×2 discharge cells are increased to eight of 2×4 discharge cells. Then, as shown in FIG. 21B, the gradation values are allocated to the respective discharge cells so that the adjacent discharge cells having side-by-side scan electrodes 22 have the same gradation value, and the adjacent discharge cells having scan electrodes 22 not side-by-side have different gradation values. At this time, the horizontally adjacent discharge cells do not have the same gradation value.

Altering the dither processing in this manner enables the crosstalk-causing conditions to be avoided, and can reduce the crosstalk likely to be caused by the dither processing and improve the image display quality.

Figure 22A:
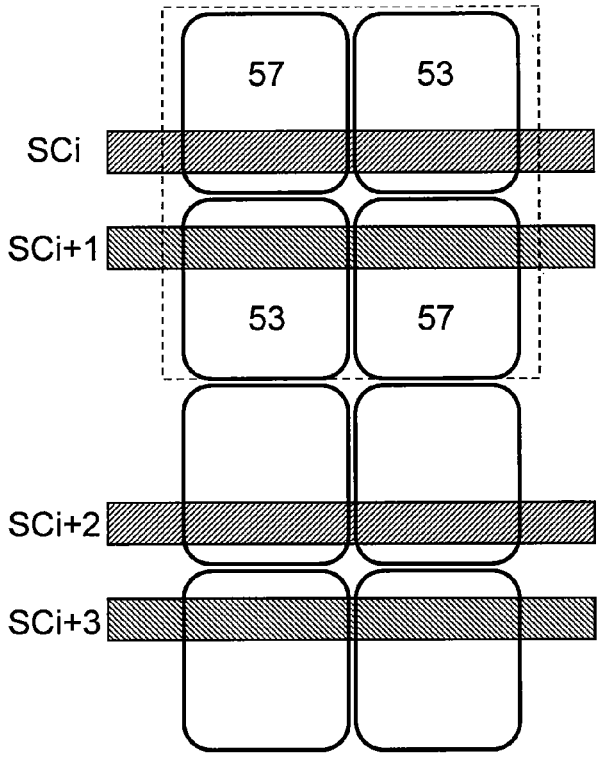
FIG. 22A is a diagram schematically showing yet another example of dither processing in accordance with the third exemplary embodiment.
Figure 22B:
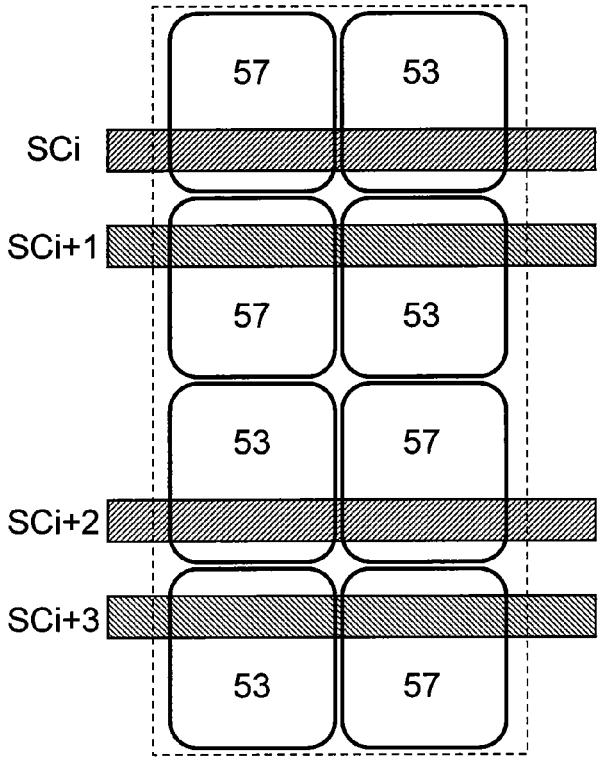
FIG. 22B is a diagram schematically showing the yet another example of the dither processing.

FIGS. 22A and 22B are diagrams schematically showing still another example of the dither processing in accordance with the third exemplary embodiment of the present invention.

As shown in FIG. 22A, for example, suppose that a discharge cell group includes adjacent discharge cells having side-by-side scan electrodes 22, and gradation values selected for dither processing (e.g. the gradation value "53" and the gradation value "57") satisfy the crosstalk-causing conditions. In such a case, the allocation of the gradation values may be altered in the following manner. That is, similar to the structure of FIG. 21B, also in FIG. 22B, one discharge cell group is set so that four of 2×2 discharge cells are increased to eight of 2×4 discharge cells. Then, as shown in FIG. 22B, the gradation values are allocated to the respective discharge cells so that the adjacent discharge cells having side-by-side scan electrodes 22 have the same gradation value, and the adjacent discharge cells having scan electrodes 22 not side-by-side have different gradation values. At this time, the horizontally adjacent discharge cells do not have the same gradation value.

Altering the dither processing in this manner also enables the crosstalk-causing conditions to be avoided, and can reduce the crosstalk likely to be caused by the dither processing.

As described above, in this exemplary embodiment, crosstalk determining unit 27 determines whether or not a plurality of gradation values selected in dither processor 71 include a combination of gradation values satisfying the crosstalk-causing conditions, and a discharge cell group set in dither processor 71 includes adjacent discharge cells having side-by-side scan electrodes 22. In response to the determination results, dither processor 71 allocates the gradation values selected for dither processing to the respective discharge cells in the discharge cell group so that the adjacent discharge cells having side-by-side scan electrodes 22 have the same gradation value, and the adjacent discharge cells having scan electrodes 22 not side-by-side have different gradation values. With this structure, dither processing can be performed so that the crosstalk-causing conditions are avoided. Thus, this structure can reduce the crosstalk in adjacent discharge cells having side-by-side scan electrodes 22 and improve the image display quality.

Though not shown, it is preferable to interchange the gradation values allocated to the respective discharge cells in each field. With this structure, intermediate gradation values can be displayed more naturally.

In this exemplary embodiment, a description is provided for a structure that has crosstalk determining unit 72 for determining whether or not a combination of gradation values satisfying the crosstalk-causing conditions is included. However, another structure as described below, for example, can be used. In this structure, when a combination of gradation values satisfying the crosstalk-causing conditions is selected in dither processor 71, the dither processor automatically performs dither processing so as not to allocate the same gradation value to adjacent discharge cells having side-by-side scan electrodes 22.

In the present invention, the number of gradation values to be used for dither processing is not limited to that in the above-described structure, and the number of gradation values to be used for dither processing may be three or larger.

Figure 23A:
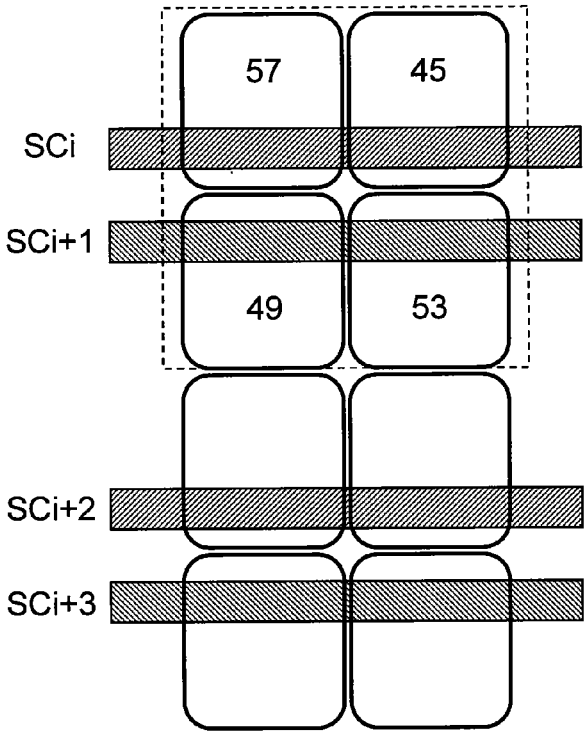
FIG. 23A is a diagram schematically showing still another example of dither processing in accordance with the third exemplary embodiment.
Figure 23B:
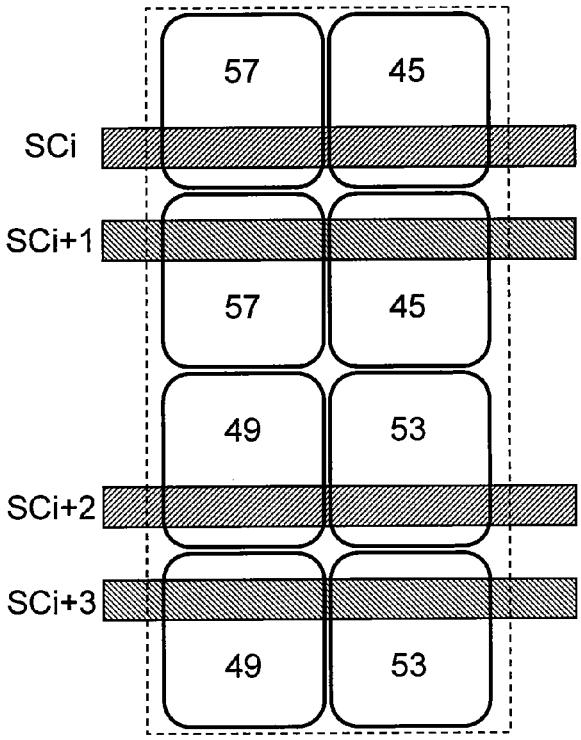
FIG. 23B is a diagram schematically showing the still another example of the dither processing.

FIG. 23A, FIG. 23B, and FIG. 23C are diagrams schematically showing still another example of the dither processing in accordance with the third exemplary embodiment of the present invention. As shown in FIG. 23A, for example, suppose that a discharge cell group includes adjacent discharge cells having side-by-side scan electrodes 22, four gradation values (e.g. the gradation value "45", the gradation value "49", the gradation value "53", and the gradation value "57") are selected for dither processing, and both of one pair (e.g. the gradation value "45" and the gradation value "49") and the other pair (e.g. the gradation value "53" and the gradation value "57") satisfy the crosstalk-causing conditions. In such a case, the allocation of the gradation values may be altered in the following manner. That is, as shown in FIG. 23B, one discharge cell group is set so that four of 2×2 discharge cells are increased to eight of 2×4 discharge cells. Then, the gradation values are allocated to the respective discharge cells so that the adjacent discharge cells having side-by-side scan electrodes 22 have the same gradation value, and the adjacent discharge cells having scan electrodes 22 not side-by-side have different gradation values. For example, such a structure can also be used.

Figure 24A:
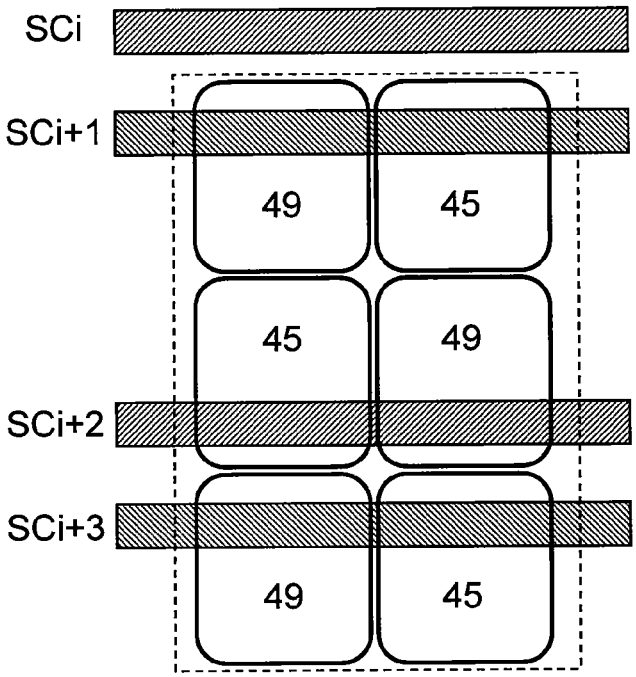
FIG. 24A is a diagram schematically showing still another example of dither processing in accordance with the third exemplary embodiment.
Figure 24B:
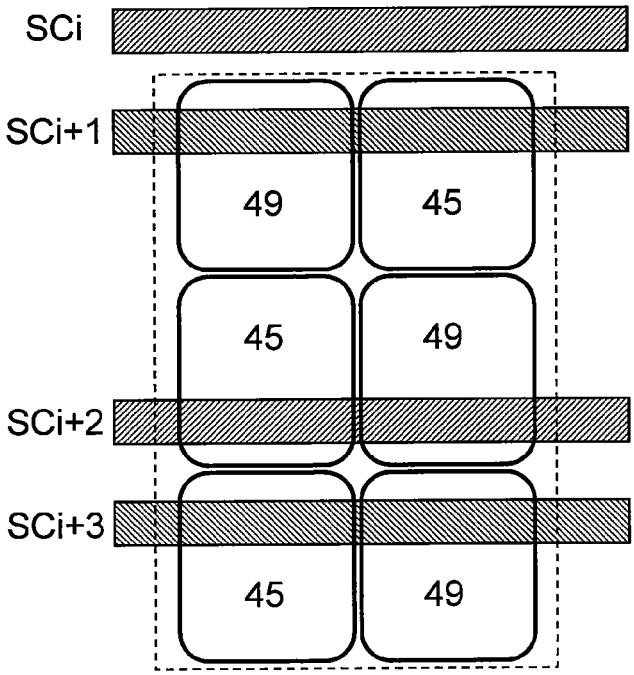
FIG. 24B is a diagram schematically showing the still another example of the dither processing.

In the present invention, the combination of discharge cells to be used for dither processing is not limited to those in the above-described structures. FIG. 24A and FIG. 24B are diagrams schematically showing still another example of the dither processing in accordance with the third exemplary embodiment of the present invention. As shown in FIG. 24A, for example, suppose that a discharge cell group is formed of six of 2×3 discharge cells, the discharge cells include adjacent discharge cells having side-by-side scan electrodes 22, and gradation values selected for dither processing (e.g. the gradation value "45" and the gradation value "49") satisfy the crosstalk-causing conditions. In such a case, the allocation of the gradation values may be altered in the following manner. That is, as shown in FIG. 24B, the number of discharge cells forming the discharge cell group is unchanged, and the gradation values are allocated to the respective discharge cells so that the adjacent discharge cells having side-by-side scan electrodes 22 have the same gradation value, and the adjacent discharge cells having scan electrodes 22 not side-by-side have different gradation values. For example, such a structure can also be used.

Figure 25:
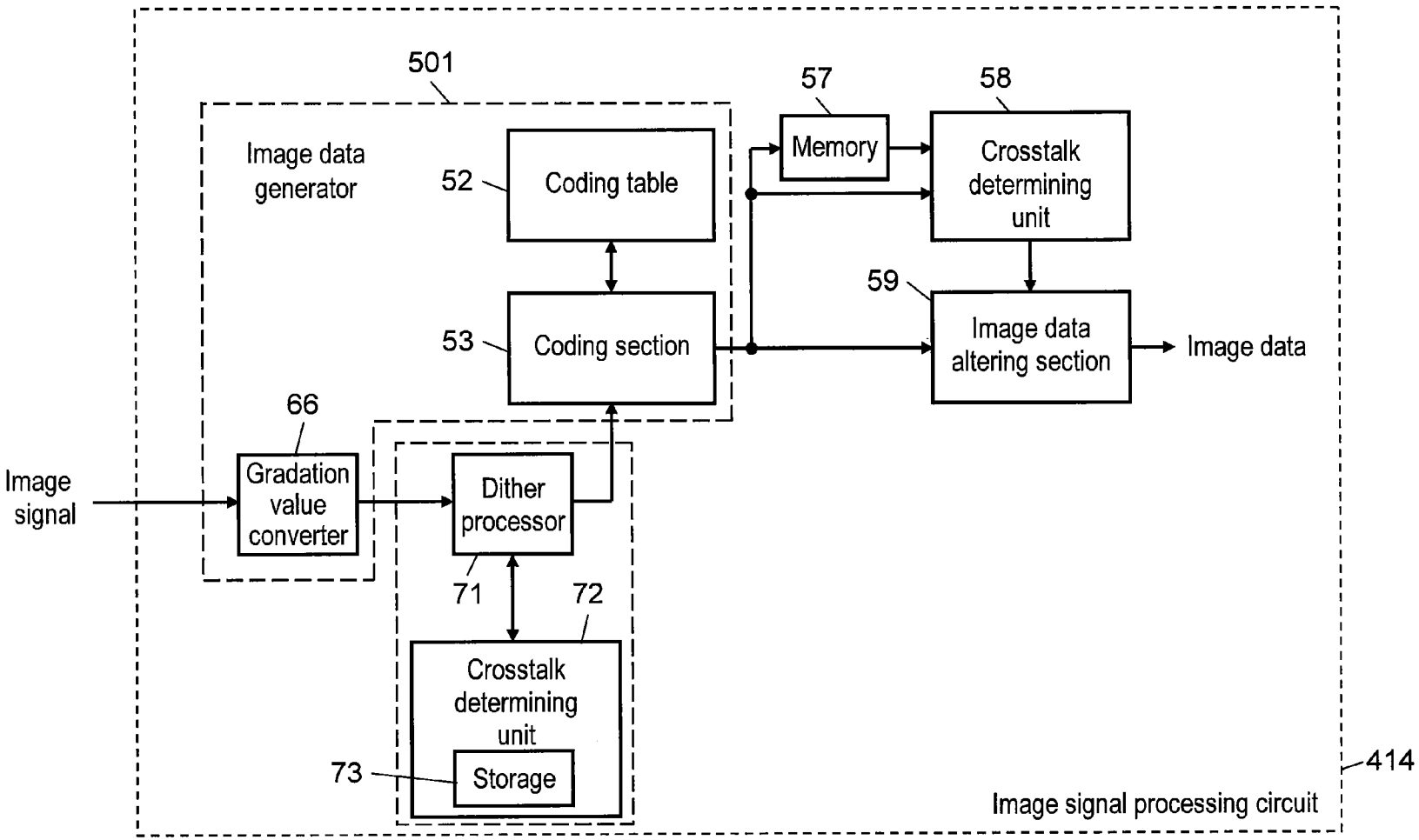
FIG. 25 is a circuit block diagram showing another example of the structure of the image signal processing circuit in accordance with the third exemplary embodiment.

Further, an image signal processing circuit can be configured by combining the structure of this exemplary embodiment with the structure of FIG. 5 in the first exemplary embodiment. FIG. 25 is a circuit block diagram showing another example of the structure of the image signal processing circuit in accordance with the third exemplary embodiment of the present invention. In FIG. 25, the circuit blocks related to the control of crosstalk reduction are shown, and the other circuit blocks are omitted. Elements similar to those in image signal processing circuit 41 of FIG. 5 and those in image signal processing circuit 413 of FIG. 18 have the same reference signs, and the descriptions of those elements are omitted.

Image signal processing circuit 414 has crosstalk determining unit 58, and image data altering section 59 of FIG. 5, and image data generator 501, dither processor 71, and crosstalk determining unit 72 of FIG. 18. With this configuration, for example, the image data of the discharge cells not undergoing dither processing can be altered by the structure of the first exemplary embodiment. Thus the image display quality can be further improved.

Figure 26:
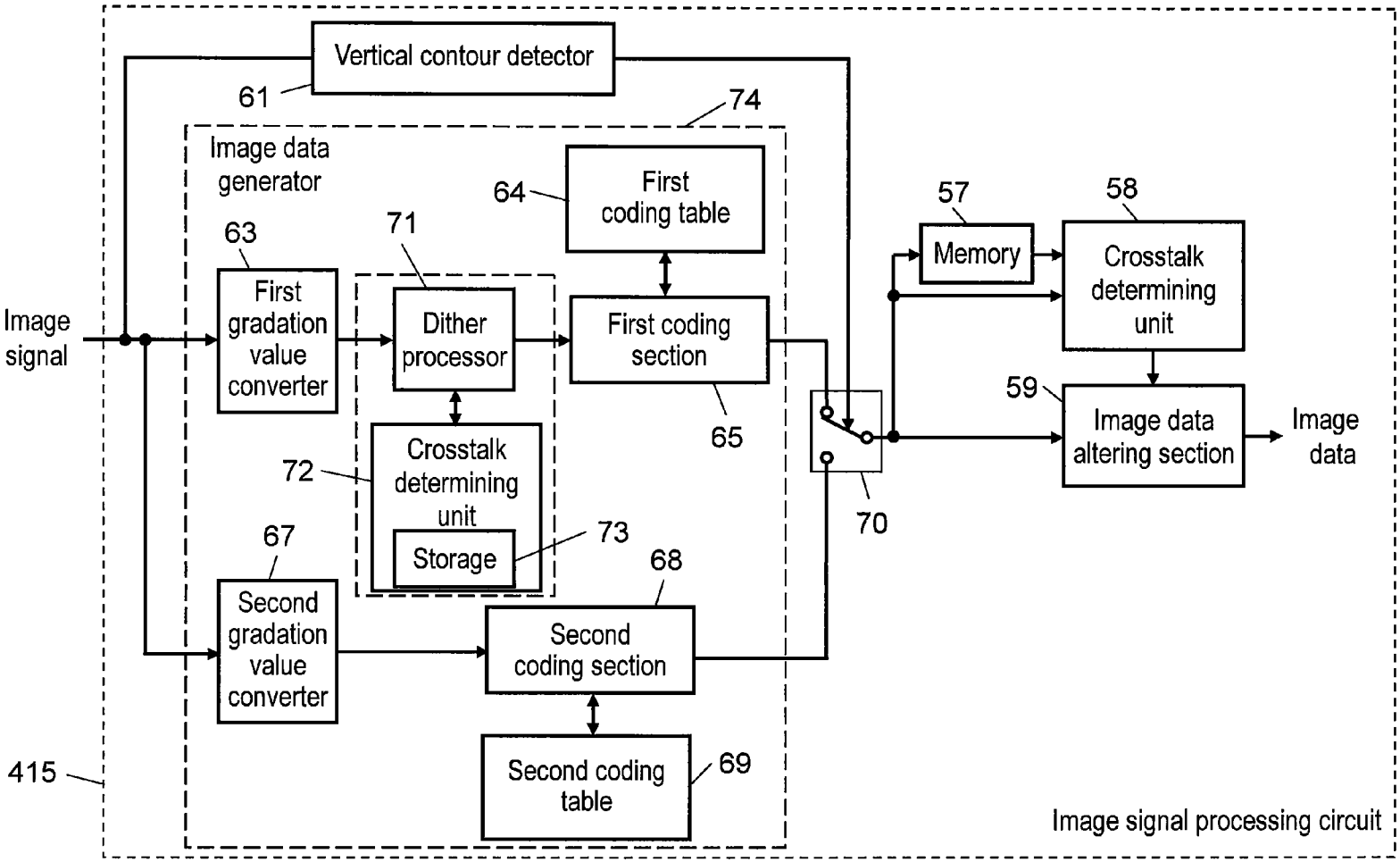
FIG. 26 is a circuit block diagram showing yet another example of the structure of the image signal processing circuit in accordance with the third exemplary embodiment.

Further, an image signal processing circuit can be configured by further combining the structure of FIG. 15 in the second exemplary embodiment with the structure of FIG. 25. FIG. 26 is a circuit block diagram showing yet another example of the structure of the image signal processing circuit in accordance with the third exemplary embodiment. In FIG. 26, the circuit blocks related to the control of crosstalk reduction are shown, and the other circuit blocks are omitted. Elements similar to those in image signal processing circuit 41 of FIG. 5, those in image signal processing circuit 411 of FIG. 15, those in image signal processing circuit 413 of FIG. 18 have the same reference signs, and the descriptions of those elements are omitted.

Image signal processing circuit 415 has the following elements:

- crosstalk determining unit 58 and image data altering section 59 of FIG. 5;
- vertical contour detector 61 and selector 70 of FIG. 15; and
- image data generator 74 formed by incorporating dither processor 71 and crosstalk determining unit 72 of FIG. 18 into image data generator 62 of FIG. 15.

With this configuration, for example, the image data of the discharge cells included in a vertical contour portion is generated by the structure of the second exemplary embodiment, the image data of the discharge cells not included in the vertical contour portion undergo dither processing from the structure of the third exemplary embodiment, and the image data of the discharge cells that is not included in the vertical contour portion and does not undergo dither processing can be altered by the structure of the first exemplary embodiment. Thus the image display quality can be further improved.

In the exemplary embodiments of the present invention, a description is provided for a structure of reducing crosstalk between adjacent discharge cells having side-by-side scan electrodes 22. However, similar charge transfer is considered to occur also between discharge cells having side-by-side sustain electrodes 23. In a structure where a sustain pulse is first applied to sustain electrode SU1 through sustain electrode SUn in sustain periods, it is considered to be highly possible that an abnormal sustain discharge is caused by crosstalk between adjacent discharge cells having side-by-side sustain electrodes 23. Therefore, in such a structure, the advantages similar to the above can be obtained with the same configuration by changing the above-described "adjacent discharge cells having side-by-side scan electrodes 22" into "adjacent discharge cells having side-by-side sustain electrodes 23".

The respective specific values shown in the exemplary embodiments of the present invention are only examples, and the present invention is not limited to these values. It is preferable to set the respective values optimum for the characteristics of the panel, the specifications of the plasma display device, or the like.

In the exemplary embodiments of the present invention, a description is provided for a structure where erasing ramp waveform L3 is applied to scan electrode SC1 through scan electrode SCn. However, erasing ramp waveform L3 may be applied to sustain electrode SU1 through sustain electrode SUn. Alternatively, an erasing discharge may be caused by a so-called narrow erasing pulse, instead of erasing ramp waveform L3.

INDUSTRIAL APPLICABILITY

The present invention can reduce crosstalk between adjacent discharge cells and cause a sustain discharge stably, in a panel that has scan electrodes and sustain electrodes arranged so that the positions of the corresponding scan electrode and sustain electrode are alternately interchanged in each display electrode pair. Thus the present invention can improve the image display quality, and is useful as a plasma display device and a driving method for the panel.

REFERENCE LIST

1 Plasma display device
10 Panel (plasma display panel)
21 Front plate
22 Scan electrode
23 Sustain electrode
24 Display electrode pair
25, 33 Dielectric layer
26 Protective layer
31 Rear plate
32 Data electrode
34 Barrier rib
35 Phosphor layer
41, 410, 411, 412, 413, 414, 415 Image signal processing circuit
42 Data electrode driving circuit
43 Scan electrode driving circuit
44 Sustain electrode driving circuit
45 Timing generating circuit
50, 62, 74, 501 Image data generator
51, 66 Gradation value converter
52 Coding table
53 Coding section
54 Dither processor
55 Subtracter
56 Adder
57 Memory
58, 72 Crosstalk determining unit
59 Image data altering section
60 Inverter
61 Vertical contour detector
63 First gradation value converter
64 First coding table
65 First coding section
67 Second gradation value converter
68 Second coding section
69 Second coding table
70 Selector
71 Dither processor
73 Storage

The invention claimed is:

1. A plasma display device comprising:

a plasma display panel, the plasma display panel being driven by a subfield method in which a plurality of subfields are set in one field, each of the subfields having an initializing period, an address period, and a sustain period, the plasma display panel having a plurality of discharge cells, each of the discharge cells having a display electrode pair formed of a scan electrode and a sustain electrode, the scan electrodes and the sustain electrodes being arranged so that positions of the scan electrode and the sustain electrode are alternately interchanged in each display electrode pair; and an image signal processing circuit for converting an image signal into image data that indicates light emission and no light emission in each subfield in each of the discharge cells, wherein the image signal processing circuit generates the image data so that a combination of the image data is avoided, the combination being such that one of two adjacent discharge cells is lit and an other of the discharge cells is unlit in one subfield of the plurality of subfields forming the one field, and the one of the discharge cells is unlit and the other of the discharge cells is lit in a subfield after the one subfield in the same field.

2. The plasma display device of claim 1, wherein the two adjacent discharge cells are adjacent discharge cells that have the scan electrodes disposed side by side.

3. The plasma display device of claim 2, wherein the image signal processing circuit includes:

an image data generator for generating image data based on an image signal;

a crosstalk determining unit for determining whether or not image data of the two adjacent discharge cells is a predetermined combination, in the image data output from the image data generator; and an image data altering section for altering the image data output from the image data generator and generating new image data, the crosstalk determining unit determines that a combination such that one of the two adjacent discharge cells is lit and an other of the discharge cells is unlit in one subfield of the plurality of subfields, and the one of the discharge cells is unlit and the other of the discharge cells is lit in a subfield after the one subfield in the same field is the predetermined combination, and when the crosstalk determining unit determines that the image data of the two adjacent discharge cells is the predetermined combination, the image data altering section alters the image data output from the image data generator so that both of the two adjacent discharge cells are lit or unlit, in at least one of two subfields, i.e. the one subfield, and a subfield after the one subfield that is a first subfield where the one of the discharge cells is unlit and the other of the discharge cells is lit.

4. The plasma display device of claim 3, wherein when the crosstalk determining unit determines that the image data of the two adjacent discharge cells is the predetermined combination, the image data altering section alters the image data so that both of the two adjacent discharge cells are lit or unlit in one of the two subfields, and the one of the two subfields has a smaller luminance weight.

5. The plasma display device of claim 3, wherein when the crosstalk determining unit determines that the image data of the two adjacent discharge cells is the predetermined combination, the image data altering section alters the image data output from the image data generator so that image data of the one of the discharge cells becomes equal to image data of the other of the discharge cells.

6. The plasma display device of claim 3, wherein when the image data altering section alters the image data so that image data after the alteration has a gradation value larger than a gradation value of image data before the alteration, the image data altering section further adds alteration to the image data so that at least one of the subfields, which have luminance weights smaller than a luminance weight of the subfield changed from no light emission to light emission by the alteration, is changed from light emission to no light emission.

7. The plasma display device of claim 3, wherein when the crosstalk determining unit determines that the image data of the two adjacent discharge cells is the predetermined combination, the image data altering section alters the image data so that a light emission state of one of the two adjacent discharge cells disposed below becomes equal to a light emission state of an other of the discharge cells disposed above, in the at least one of two subfields.

8. The plasma display device of claim 2, wherein the image signal processing circuit includes:

a vertical contour detector for detecting a contour portion in a vertical direction in an image, and determining whether or not the two adjacent discharge cells are included in the contour portion; and an image data generator having a first coding table and a second coding table, for generating image data based on an image signal, the first coding table and the second coding table being formed of a plurality of coding data where combinations of light emission and no light emission in the respective subfields are correlated with gradation values to be used for display, in the image data generator, the second coding table is formed of coding data where all subfields after any no-light-emission subfield in the same field are changed into no light emission, when the vertical contour detector determines that the two adjacent discharge cells are included in the contour portion, the image data generator generates image data of the two adjacent discharge cells by using the second coding table.

9. The plasma display device of claim 2, wherein the image signal processing circuit includes a dither processor for performing dither processing by selecting at least two different gradation values and allocating any one of the at least two gradation values to a plurality of respective discharge cells combined in matrix, when the plurality of discharge cells combined in matrix include the two adjacent discharge cells, and the at least two gradation values include two gradation values, the dither processor performs dither processing by allocating equal one of the two gradation values to the two adjacent discharge cells and allocating different ones of the two gradation values to two adjacent discharge cells having the scan electrodes not side-by-side, the two gradation values being such that one subfield of the plurality of subfields is a light-emission subfield at one of the gradation values and is a no-light-emission subfield at an other of the gradation values, and a subfield after the one subfield in the same field is a subfield that is a no-light-emission subfield at the one of the gradation values and is a light-emission subfield at the other of the gradation values.

10. The plasma display device of claim 9, wherein when the plurality of discharge cells combined in matrix include the two adjacent discharge cells, and the at least two gradation values include two gradation values, the dither processor increases the number of discharge cells combined in matrix for the dither processing, the two gradation values being such that one subfield of the plurality of subfields is a light-emission subfield at one of the gradation values and is a no-light-emission subfield at an other of the gradation values, and a subfield after the one subfield in the same field is a subfield that is a no-light-emission subfield at the one of the gradation values and is a light-emission subfield at the other of the gradation values.

11. A driving method for a plasma display panel, the plasma display panel having a plurality of discharge cells, each of the discharge cells having a display electrode pair formed of a scan electrode and a sustain electrode, the scan electrodes and the sustain electrodes being arranged so that positions of the scan electrode and the sustain electrode is alternately interchanged in each display electrode pair, the driving method comprising:

setting a plurality of subfields in one field, each of the subfields having an initializing period, an address period, and a sustain period;

converting an image signal into image data indicating light emission and no light emission in each subfield in each of the discharge cells; and generating the image data so that a combination of image data is avoided, the combination being such that one of two adjacent discharge cells is lit and an other of the discharge cells is unlit in one subfield of the plurality of subfields forming the one field, and the one of the discharge cells is unlit and the other of the discharge cells is lit in a subfield after the one subfield in the same field.

12. The plasma display device of claim 3, wherein the image signal processing circuit includes:

a vertical contour detector for detecting a contour portion in a vertical direction in an image, and determining whether or not the two adjacent discharge cells are included in the contour portion; and an image data generator having a first coding table and a second coding table, for generating image data based on an image signal, the first coding table and the second coding table being formed of a plurality of coding data where combinations of light emission and no light emission in the respective subfields are correlated with gradation values to be used for display, in the image data generator, the second coding table is formed of coding data where all subfields after any no-light-emission subfield in the same field are changed into no light emission, when the vertical contour detector determines that the two adjacent discharge cells are included in the contour portion, the image data generator generates image data of the two adjacent discharge cells by using the second coding table.

13. The plasma display device of claim 3, wherein the image signal processing circuit includes a dither processor for performing dither processing by selecting at least two different gradation values and allocating any one of the at least two gradation values to a plurality of respective discharge cells combined in matrix, when the plurality of discharge cells combined in matrix include the two adjacent discharge cells, and the at least two gradation values include two gradation values, the dither processor performs dither processing by allocating equal one of the two gradation values to the two adjacent discharge cells and allocating different ones of the two gradation values to two adjacent discharge cells having the scan electrodes not side-by-side, the two gradation values being such that one subfield of the plurality of subfields is a light-emission subfield at one of the gradation values and is a no-light-emission subfield at an other of the gradation values, and a subfield after the one subfield in the same field is a subfield that is a no-light-emission subfield at the one of the gradation values and is a light-emission subfield at the other of the gradation values.

14. The plasma display device of claim 8, wherein the image signal processing circuit includes a dither processor for performing dither processing by selecting at least two different gradation values and allocating any one of the at least two gradation values to a plurality of respective discharge cells combined in matrix, when the plurality of discharge cells combined in matrix include the two adjacent discharge cells, and the at least two gradation values include two gradation values, the dither processor performs dither processing by allocating equal one of the two gradation values to the two adjacent discharge cells and allocating different ones of the two gradation values to two adjacent discharge cells having the scan electrodes not side-by-side, the two gradation values being such that one subfield of the plurality of subfields is a light-emission subfield at one of the gradation values and is a no-light-emission subfield at an other of the gradation values, and a subfield after the one subfield in the same field is a subfield that is a no-light-emission subfield at the one of the gradation values and is a light-emission subfield at the other of the gradation values.

15. The plasma display device of claim 12, wherein the image signal processing circuit includes a dither processor for performing dither processing by selecting at least two different gradation values and allocating any one of the at least two gradation values to a plurality of respective discharge cells combined in matrix, when the plurality of discharge cells combined in matrix include the two adjacent discharge cells, and the at least two gradation values include two gradation values, the dither processor performs dither processing by allocating equal one of the two gradation values to the two adjacent discharge cells and allocating different ones of the two gradation values to two adjacent discharge cells having the scan electrodes not side-by-side, the two gradation values being such that one subfield of the plurality of subfields is a light-emission subfield at one of the gradation values and is a no-light-emission subfield at an other of the gradation values, and a subfield after the one subfield in the same field is a subfield that is a no-light-emission subfield at the one of the gradation values and is a light-emission subfield at the other of the gradation values.

16. The plasma display device of claim 13, wherein when the plurality of discharge cells combined in matrix include the two adjacent discharge cells, and the at least two gradation values include two gradation values, the dither processor increases the number of discharge cells combined in matrix for the dither processing, the two gradation values being such that one subfield of the plurality of subfields is a light-emission subfield at one of the gradation values and is a no-light-emission subfield at an other of the gradation values, and a subfield after the one subfield in the same field is a subfield that is a no-light-emission subfield at the one of the gradation values and is a light-emission subfield at the other of the gradation values.

17. The plasma display device of claim 14, wherein when the plurality of discharge cells combined in matrix include the two adjacent discharge cells, and the at least two gradation values include two gradation values, the dither processor increases the number of discharge cells combined in matrix for the dither processing, the two gradation values being such that one subfield of the plurality of subfields is a light-emission subfield at one of the gradation values and is a no-light-emission subfield at an other of the gradation values, and a subfield after the one subfield in the same field is a subfield that is a no-light-emission subfield at the one of the gradation values and is a light-emission subfield at the other of the gradation values.

18. The plasma display device of claim 15, wherein when the plurality of discharge cells combined in matrix include the two adjacent discharge cells, and the at least two gradation values include two gradation values, the dither processor increases the number of discharge cells combined in matrix for the dither processing, the two gradation values being such that one subfield of the plurality of subfields is a light-emission subfield at one of the gradation values and is a no-light-emission subfield at an other of the gradation values, and a subfield after the one subfield in the same field is a subfield that is a no-light-emission subfield at the one of the gradation values and is a light-emission subfield at the other of the gradation values.

* * * * *